US005665530A

United States Patent [19]

Oyamada et al.

[11] Patent Number: 5,665,530

[45] Date of Patent: Sep. 9, 1997

[54] SILVER HALIDE EMULSION AND PHOTOGRAPHIC MATERIAL USING THE SAME

[75] Inventors: Takayoshi Oyamada; Takekimi Shiozawa; Seiji Yamashita, all of Kanagawa, Japan

[73] Assignee: Fuji Photo Film Co., Ltd., Kanagawa, Japan

[21] Appl. No.: 521,579

[22] Filed: Aug. 30, 1995

[30] Foreign Application Priority Data

Aug. 30, 1994 [JP] Japan ..... 6-227431

[51] Int. Cl.[6] ..... G03C 1/035; G03C 1/815

[52] U.S. Cl. ..... 430/567; 430/139; 430/508; 430/509; 430/524; 430/512; 430/966; 430/603; 430/605

[58] Field of Search ..... 430/139, 508, 430/509, 524, 512, 567, 966, 603, 605

[56] References Cited

U.S. PATENT DOCUMENTS

| | | | |
|---|---|---|---|
| 4,232,116 | 11/1980 | Jamieson | 430/510 |
| 5,264,337 | 11/1993 | Maskasky | 430/567 |
| 5,279,430 | 1/1994 | Benton . | |
| 5,292,632 | 3/1994 | Maskasky | 430/567 |
| 5,310,635 | 5/1994 | Szajewski | 430/567 |
| 5,314,798 | 5/1994 | Brust et al. | 430/567 |
| 5,320,938 | 6/1994 | House et al. | 430/567 |
| 5,356,764 | 10/1994 | Szajewski et al. | 430/567 |
| 5,397,687 | 3/1995 | Willems et al. | 430/502 |
| 5,399,477 | 3/1995 | Maskasky | 430/567 |
| 5,411,852 | 5/1995 | Maskasky | 430/567 |
| 5,413,904 | 5/1995 | Chang et al. | 430/567 |
| 5,449,596 | 9/1995 | Kawai et al. | 430/567 |
| 5,472,836 | 12/1995 | Haga | 430/567 |

FOREIGN PATENT DOCUMENTS

| | | |
|---|---|---|
| 0 534 395 A1 | 3/1993 | European Pat. Off. . |
| 0 584 644 A2 | 3/1994 | European Pat. Off. . |
| 0 617 317 A1 | 9/1994 | European Pat. Off. . |
| 0 617 318 A2 | 9/1994 | European Pat. Off. . |
| 0 617 320 A2 | 9/1994 | European Pat. Off. . |
| 0 617 321 A1 | 9/1994 | European Pat. Off. . |
| 0 617 322 A1 | 9/1994 | European Pat. Off. . |
| 0 617 325 A1 | 9/1994 | European Pat. Off. . |
| 0 616 255 A1 | 9/1994 | European Pat. Off. . |
| WO 94/22051 | 9/1994 | WIPO . |
| WO 94/22054 | 9/1994 | WIPO . |

OTHER PUBLICATIONS

Francois et al., Cristaus De Bromure D'Argent Plats, Limites Par Des Faces (100) Et Non Macles, Journal of Crystal Growth 23 (1974) pp. 207–213.

*Primary Examiner*—Mark F. Huff

*Attorney, Agent, or Firm*—Sughrue, Mion, Zinn, Macpeak & Seas

[57] ABSTRACT

A silver halide emulsion which comprises at least one dispersion medium and silver halide grains, wherein not less than 30% of the total projected area of the silver halide grains accounts for tabular grains each (i) having a {100} face as a major face, (ii) having an aspect ratio (diameter/thickness) of not less than 1.5, and (iii) having a nucleus during nucleus formation, the nucleus being present within the square of not more than 10% of the entire projected area of each of said silver halide grains when viewed the silver halide grains from the vertical direction to the major faces, the square containing one corner of each of said silver halide grains.

14 Claims, 5 Drawing Sheets

GROWTH HISTORY INTRODUCED BY ADDING KI

NUCLEUS DURING NUCLEUS FORMATION

--------NUCLEUS HISTORY INTRODUCED BY ADDING KI

SILVER HALIDE EMULSION AND PHOTOGRAPHIC MATERIAL USING THE SAME

FIELD OF THE INVENTION

The present invention relates to a silver halide (hereinafter sometimes referred to as "AgX") emulsion useful in a photographic field and, particularly, to an AgX emulsion containing tabular grains having a {100} face as a major face.

BACKGROUND OF THE INVENTION

Using tabular AgX emulsion grains in a photographic material gives improved color sensitivity, sharpness, light scattering, covering power, development progression, graininess, etc., compared with using non-tabular AgX grains. Therefore, tabular grains having twin planes parallel to each other and having {100} faces as major faces mainly have been used.

However, when a large amount of sensitizing dye is adsorbed onto AgX grains, grains having {100} faces normally show better color sensitizing properties. Accordingly, the development of the tabular grains having {100} faces as major faces has been desired. Tabular grains having {100} faces wherein the shapes of the major faces are right angled parallelograms are disclosed in JP-A-51-88017 (the term "JP-A" as used herein means a "published, unexamined Japanese patent application"), JP-B-64-8323 (the term "JP-B" as used herein means an "examined Japanese patent publication") , EP 0534395A1, U.S. Pat. No. 5,292,632, U.S. Pat. No. 5,264,337, U.S. Pat. No. 5,320,938 and JP-A-6-59360. However, all of these grains have nuclei during nucleus formation (hereinafter referred to as "nucleus" (or "nuclei")) at the center of the grains or the positions of the nuclei are not defined clearly. When the nuclei are at the center of the grains, the grains are inferior in anisotropic growth and difficult to grow in terms of keeping thickness small. Such grains also have the drawback of grain formation of even thickness being difficult. The description that grains grow by dislocation is disclosed in *Journal of Crystal Growth,* 23 (1974), pages 207 to 213, but the direction of the dislocation line in that article is in the {100} direction parallel to the side face of the grain and differs from the direction of the dislocation line of the grain of the present invention. When the anisotropic growth of the grain begins at the dislocation line extending to the {100} direction, the grain has, in general, a sectorial shape with one corner of the main plane being rounded in shape, therefore, inferior in anisotropic growth.

In the medical field in recent years, the replenishment rate of replenishers has been reduced in view of environmental protection and space-saving. However, the reduced replenishment rate increases the accumulated amount of substances dissolved from photographic materials, leading to deteriorated photographic performance. In particular, surfactants are used in a large amount as an electrostatic characteristic improving agent, and dissolved-out substances accumulate in processing solutions and cause foaming, leading to development unevenness.

Forming images using tabular grains having {100} faces as major faces by UV light exposure gives insufficient sharpness.

The present inventors have found as a result of extensive studies that it is effective to use high silver chloride content tabular grains having less light scattering even in a UV light exposure range and having higher light transmitting property compared to silver bromide in order to increase image sharpness. However, images are blurred and sharpness decreases by these methods alone due to halation and crossover light when the photographic material to be used has light-sensitive layers on both sides of the support. With respect to the halation and crossover light effects, tabular grains having higher silver chloride contents are affected rather largely because of their smaller light absorption coefficient and larger light transmitting property. The present inventors have found that by using a UV absorbing agent this problem could be solved and excellent sharpness could be obtained.

In addition, it also has been found that because such a constitution has no use for spectral sensitizing dyes and crossover cut dyes in the visible region, problems such as the contamination of processing solutions with colors, dyes and decomposed products thereof by rapid processing and reduced replenisher processing or coloring of photographic materials by their remaining in photographic materials do not arise. Therefore, an ideal system is feasible.

Further, although silver chloride tabular grains are excellent for rapid processing and in fixing properties and the like as described in the prior art, at the same time, the light absorption coefficient increases by UV light exposure. As a result, light absorption by the grains in the upper layer increases and the quantity of light to be absorbed by the grains in the lower layer decreases. As a result, photographic materials become relatively low contrast. When photographic materials are low contrast, the contrast of images formed lowers and visual sharpness reduces. This problem is more conspicuous in the silver bromide system in which light absorption reaches long wave. To cope with this problem regarding UV light, methods of increasing light transmitting property by using tabular silver bromide grains or using silver chloride are disclosed, for example, in WO 93/01521. However, sufficiently high gradation cannot be obtained by these methods.

Accordingly, a photographic material having a curve of high visual sharpness and high gradation in combination with a fluorescent intensifying screen emitted by UV light exposure had not been realized. As a result of extensive studies in these circumstances, the present inventors have found that a photographic material having higher contrast can be constituted not only by increasing the transmittance of silver halide grains by raising the silver chloride content and making grains tabular so that UV light can sufficiently reach the lower layer, but also adopting a multilayer structure with the emulsion layer of the highest sensitivity being disposed as the lower layer. Moreover, in super rapid processing of the total processing time of dry to dry of less than 60 seconds, when the high sensitivity emulsion layer is disposed as a lower layer, in general, diffusion of the developing solution is slow and the intrinsic performance of the high sensitivity emulsion cannot be developed and the sensitivity is reduced. Therefore, sufficiently high contrast images cannot be formed. However, it has been found, beyond our expectation, that by using tabular grains having a high silver chloride content as in the present invention, the high sensitivity emulsion in the lower layer exhibits intrinsic photographic performance and high contrast images can be formed. Further, it has been found that such a phenomenon is particularly effective in X-ray image formation using a fluorescent intensifying screen emitted by UV light exposure.

SUMMARY OF THE INVENTION

An objects of the present invention is to provide an AgX emulsion with excellent anisotropic growth, with very slow growing speed in the width direction, extremely excellent uniformity among grains, sensitivity, graininess, spectral sensitivity, and the sharpness in image formation by UV light exposure. A further object is to provide a photographic material using the same, AgX emulsion and also a photographic material which can be processed without generating development unevenness and reduced sensitivity when continuously development processed with reduced replenishing conditions and having excellent electrostatic characteristics.

The objects of the present invention have been achieved by the following.

(1) A silver halide emulsion which comprises at least a dispersion medium and silver halide grains, wherein 30% or more of the total projected area of the silver halide grains accounts for tabular grains each (i) having a {100} face as a major face, (ii) having an aspect ratio (diameter/thickness) of 1.5 or more, and (iii) having a nucleus during nucleus formation, the nucleus during nucleus formation being present in a square not exceeding 10% of the entire silver halide grain projected area containing one corner upon viewing the silver halide grains from the vertical direction to the major faces.

(2) A silver halide emulsion which comprises at least a dispersion medium and silver halide grains, wherein 20% or more of the total projected area of the silver halide grains accounts for tabular grains each (i) having a {100} face as a major face, (ii) having an aspect ratio (diameter/thickness) of 1.5 or more, and (iii) having a dislocation line, the only one intersection of the dislocation line or the extension line of the dislocation line with the side face of the {100} face of the silver halide grain being present on not exceeding 15% of the side face containing one corner of {100} face of the silver halide grain when viewed the silver halide grains from the vertical direction to the major faces. Preferably, each tabular grain has a nucleus during nucleus formation, the nucleus during nucleus formation being present in the square of not exceeding 10% of the entire projected area of the silver halide grain containing one corner upon viewing the silver halide grains from the vertical direction to the major faces.

(3) The silver halide emulsion as described in (2), wherein two of the dislocation lines can be observed.

(4) The silver halide emulsion as described in (2) and (3), wherein, when viewed from the vertical direction to the major faces, the only one intersection of the dislocation line or the extension line of the dislocation line with the side face of the {100} face of the silver halide grain is present on the side face of the {100} face of not exceeding 7% of the entire projected area of the silver halide grain containing one corner.

(5) The silver halide emulsion as described in (2) to (4), wherein 40% or more of the total projected area of the silver halide grains are tabular grains.

(6) The silver halide emulsion as described in (2) to (5), wherein the dislocation line and/or the extension line of the dislocation line extend(s) from the nucleus during nucleus formation.

(7) A silver halide emulsion, wherein, after nucleus formation, and during physical ripening and/or during grain growth, and when 5 to 99% of silver amount based on the silver amount of the completed grains has been added, the nucleus and/or the dislocation line(s) described in (1) to (6) can be viewed.

(8) The silver halide emulsion as described in (1) to (7), wherein said grains are gold and/or chalcogen sensitized.

(9) A silver halide photographic material comprising at least one emulsion layer described in (1) to (8), wherein a dissolution resistant electrically conductive material is contained on the emulsion layer side of the support.

(10) The silver halide photographic material described in (9), wherein said dissolution resistant electrically conductive material is a metal oxide.

(11) A silver halide photographic material which contains the emulsions described in (1) to (8) and an ultraviolet absorbing agent.

(12) A silver halide photographic material comprising two or more silver halide emulsion layers on at least one side of a support, wherein optional two emulsion layers of said two or more silver halide emulsion layers satisfy the following 1) and 2):

1) each emulsion layer contains at least one emulsion described in (1) to (8);

2) of the two emulsion layers, emulsion 1) contained in the emulsion layer nearer to the support is more sensitive than emulsion 1) contained in the emulsion layer farther from the support.

(13) The silver halide photographic material for radiographic use described in (9) to (12), wherein said photographic material is used in combination with a fluorescent intensifying screen emitted by X-ray exposure having a peak at 400 nm or less.

DETAILED DESCRIPTION OF THE INVENTION

Figure 1:
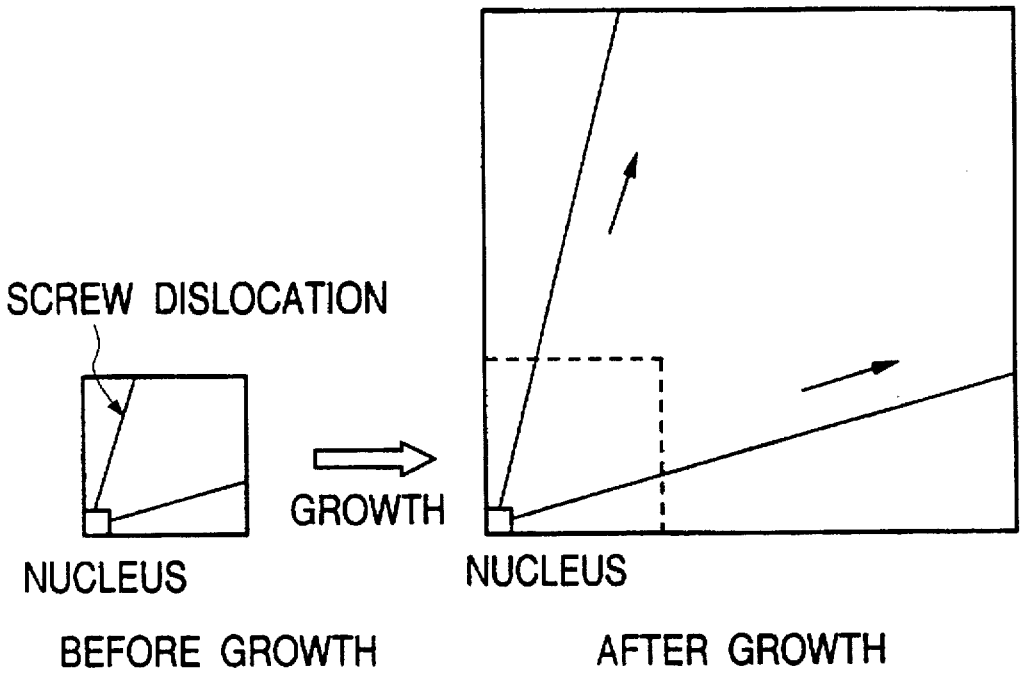
FIG. 1 is a typical example of anisotropic growth of the silver halide grains of Emulsions A and B of the present invention in Example 1.

In the present specification, the projected area of the silver halide grains means a projected area of grains when the AgX emulsion grains are disposed so that the grains do not overlap each other and the major faces of the tabular grains are parallel to the substrate. The circle-corresponding diameter of the tabular grain means the diameter of the circle having an area equal to the projected area of the grains upon viewing the grains with an electron microscope. The thickness is the distance between the major faces of the tabular grains. The aspect ratio is the value obtained by dividing the circle-corresponding projected diameter of the tabular grain by the thickness. The thickness is preferably 0.5 μm or less, more preferably from 0.03 to 0.3 μm, and still further preferably from 0.05 to 0.2 μm. The circle-corresponding diameter of the tabular grain is preferably 10 μm or less and more preferably from 0.2 to 5 μm. The distribution of the circle-corresponding diameter is preferably monodisperse, and the variation coefficient of the distribution (standard deviation/average diameter) is preferably from 0 to 0.4, more preferably from 0 to 0.3 and still more preferably from 0 to 0.2. Further, the shape of the major face of the tabular grain is a right angled parallelogram and the adjacent major face edge ratio [(the length of the long edge/the length of the short edge) of one grain] is from 1 to 10, preferably from 1 to 5, and more preferably from 1 to 2.

The AgX emulsion of the present invention is an AgX emulsion which comprises at least a dispersion medium and AgX grains, and 30% or more, preferably from 60 to 100%, and more preferably from 80 to 100%, of the entire projected area of the AgX grains is tabular grains having {100} faces as major faces and having an aspect ratio of 1.5 or more, preferably 2.0 or more, more preferably from 3 to 25, and still more preferably from 3 to 10.

For the formation of the tabular grains, a crystal defect such as screw dislocation should be integrated at the time of nucleus formation and the growth to the specific direction should be accelerated. The crystal defect of the present invention was not confirmed as screw dislocation but it is thought to be presumably screw dislocation from the direction of the anisotropic growth.

The corner of the tabular grain means the intersecting part of the side faces of the {100} face of the tabular grain. Therefore, tabular grains have, in general, four corners.

The AgX grain of the present invention preferably contains 30% or more, more preferably 50% or more, and particularly preferably from 90% to 100%, of AgCl.

The nucleus part of the tabular grain includes the part of the grain invested with an anisotropic growing property by halide gap by the inclusion of different halides and/or impurities, where the grain intrinsically does not have an anisotropic growing property. Grains are often invested with an anisotropic growing property by the thereinto introduction of dislocation and the like. In the present invention, the nucleus of the grain is present in the square of not exceeding 10%, preferably not exceeding 7%, of the entire projected area containing one corner. The place where the nucleus is present often can be confirmed by the presence of distortion of the lattice by observation of a direct low temperature transmission type electron microscopic image (hereinafter abbreviated to "direct TEM image"). Even if lattice distortion at the nucleus part cannot be observed by the TEM image, indirect confirmation of where the nucleus is present should be sufficient by the direct TEM image by the introducing growth history into the grain by the method of adding different halides such as $I_2$ and/or $Br_2$ in an amount of from 0.01 to 5 mol %, more preferably from 0.05 to 3 mol %, and still more preferably from 0.1 to 1 mol %, based on the addition amount of silver or, in the case of $I_2$, by the method of observing low temperature emission (see, e.g., *Journal of Imaging Science,* Vol. 31, pages 15 to 26 (1987). The nucleus of the grain of the present invention often differs in composition from the part other than the nucleus, but the compositions need not necessarily differ. However, in such cases, the presence of the nucleus has to be confirmed by introducing growth history, etc., into the grain. Preferably not less than 30%, more preferably not less than 50%, particularly preferably not less than 70%, of the total projected area of the silver halide grains is tabular grains each having the nucleus of the present invention.

When viewed from the vertical direction to the major face of the tabular grain by the direct TEM image, only one intersection of the dislocation line or the extension line of the dislocation line with the side face of the tabular grain is preferably present on not exceeding 15%, more preferably not exceeding 7%, and still more preferably not exceeding 5%, of the side face of the {100} face containing one corner. The meaning "only one intersection . . . is present on not exceeding 15% of the side face of the {100} face containing one corner" will be explained below. When viewed from the vertical direction to the major face of the tabular grain, four edges (sides) and four corners can be observed. On the four edges, the portion from the four corners up to each 15% edge length is referred to as portion (a), and the other portion is referred to as portion (b). When focused on one dislocation line observed when viewing the tabular grain from the vertical direction to the major face of the tabular grain, there exist two intersections between the dislocation line or the extension line of the dislocation line and the four edges. "Only one intersection . . . is present on not exceeding 15% of the side face of {100} face containing one corner" means that only one intersection of the two intersections intersects at portion (a). This concept also can be applied to the case "only one intersection . . . is present on not exceeding 7% of the side face of {100} face containing one corner" and "only one intersection . . . is present on not exceeding 5% of the side face of the {100} face containing one corner".

Figure 2:
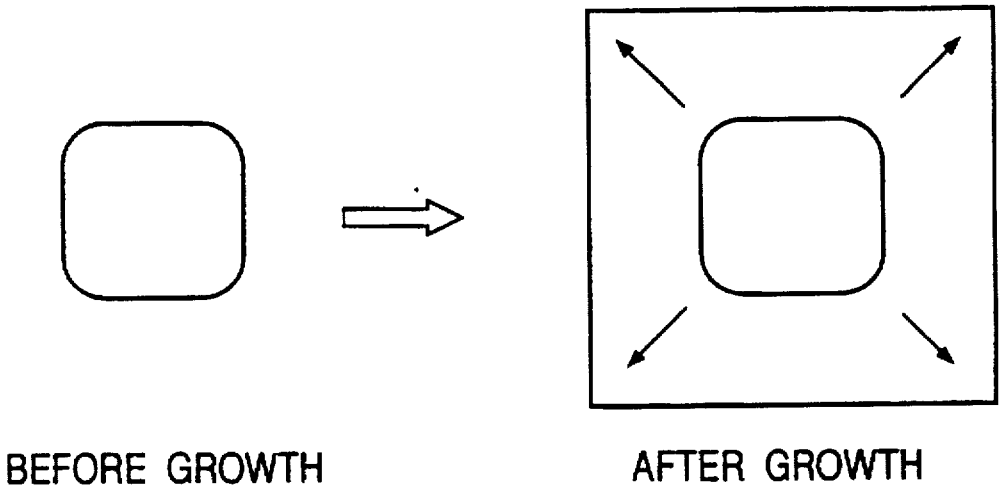
FIG. 2 PRIOR ART
FIG. 2 is a typical example of anisotropic growth of the silver halide grains of Comparative Emulsions C and D in Example 1.

The dislocation line of the present invention can be largely seen in a grain after nucleus formation and before growth. During physical ripening when the dislocation line (s) in the grain can be confirmed best, the dislocation lines can be observed in the grains accounting for preferably from 20% to 100%, more preferably from 40% to 100%, of the total projected area of the silver halide grains. The tabular grain anisotropically grows, in general, from the nucleus only in two directions along these dislocation lines as in FIG. 1. However, when the grains have been subjected to excessive physical ripening before grain growth and the corners of the grains have been dissolved out, grains which have lost the characteristic of growing along only two directions (FIG. 2) occur in some cases. The nucleus in the grain which grows as in FIG. 2 is normally present in the neighborhood of the center of the grain when viewed from the vertical direction to the major face of the grain. When the grain growth was conducted by one kind of halide, dislocation lines vanish in some cases, but if the presence of the anisotropic growing property of the grain can be confirmed by the above described method of introducing the growth history etc., such grains are included in the present invention. When the dislocation lines can be observed in the grains during grain formation when 5 to 99% of silver amount is added based on the silver amount of the completed silver halide grains, such grains also are included in the present invention. The number of dislocation lines observed in a grain may be one, two, three or more, but one or two dislocation lines are preferred, and two dislocation lines are more preferred. The extending direction of the dislocation line is, when viewed from the vertical direction to the major face, preferably at 5° to 40°, more preferably 5° to 25°, and still more preferably 10° to 25°, with the side face of the {100} face containing the nucleus. Further, when two dislocation lines exist in the grain, the angle between the two dislocation lines is preferably 30° to 80°, more preferably 40° to 70°.

Moreover, the dislocation line of the present invention may extend from the nucleus during nucleus formation. The percentage of the dislocation line extend from the nucleus during nucleus formation is preferably 30% to 100%, more preferably 50% to 100%.

One example of direct TEM method is described below.

1. Preparation of Sample

The emulsions during grain formation and/or after grain formation were added to a methanol solution containing phenyl mercaptotetrazole ($1\times10^{-3}$ to $1\times10^{-2}$ mol/mol Ag) so as not to generate grain deformation, then the grains were removed by centrifugation and dropped on a supporting base (mesh) for a sample lined with a carbon supporting lamella for observation by an electron microscope, and dried to obtain samples.

2. Grain Observation

The prepared samples were observed using an electron microscope JEM-2000FXII manufactured by Nippon Electronic Co., Ltd. at an accelerating voltage of 200 kV, a magnification of 5,000 to 50,000-fold, using a sample cooling holder 626-0300 Cryostation manufactured by Gatan Co., Ltd. at a temperature of observation of −120° C. Further, for grains whose dislocation lines could not be observed in such a manner, the presence of dislocation was confirmed by making observations with the samples slanting.

Almost all the dislocation lines which were observed extended from the nuclei to the edges but some were observed partially and those are also emulsions of the present invention.

To form grains having such a constitution, ripening is preferably carried out under conditions such that each corner of the tabular grains is not dissolved, for example, ripening in the presence of fine grains. Further, to grow grains so as to maintain their anisotropic growing property, low supersaturation addition of an $Ag^+$ salt solution and an $X^-$ salt solution and/or low supersaturation addition of an $X^-$ salt solution may be effective.

The ripening and/or growth of the grains are/is conducted under conditions of a pCl of 1.6 or more, preferably 2.5 to 1.6. Formation of grains having other halide compositions is also preferably conducted in the same $Cl^-$ concentration, because the formation of the tabular grains is preferably conducted under the conditions of cubic grain formation, and the $Cl^-$ concentration conditions correspond to the conditions of cubic grain formation. The excess $Cl^-$ can be regarded as a kind of crystal habit inhibitor.

The anisotropic growth of the silver halide grains of the present invention can be conducted with AgX fine grains.

Because the degree of supersaturation of the system is preferably minimal, vanishable maximum grains are preferably used as the fine grains to be added. Because the sizes of the vanishable grains differ depending on the sizes of the {100} tabular grains which are growing, the sizes of the fine grains added are preferably made larger according to growing. The growth of the tabular grains is carried out by Ostwald ripening using these AgX fine grains. The fine grain emulsion can be added either continuously or intermittently. The fine grain emulsions can be prepared continuously in a mixing vessel provided near the reaction vessel by supplying an $AgNO_3$ solution and an $X^-$ salt solution and can be added immediately and continuously to the reaction vessel, or may be previously prepared in another vessel in a batch system and added to the reaction vessel continuously or intermittently. The fine grain emulsion can be added either as a liquid or a dried powder. The fine grains preferably substantially do not contain multiple twin grains. "Multiple twin-crystalline grain" as used herein means a grain having two or more twin planes per one grain. "Substantially do not contain" as used herein means the number ratio of multiple twin-crystalline grains is 5% or less, preferably 1% or less, and more preferably 0.1% or less. Further, the fine grains preferably substantially do not contain single twin-crystalline grains. Moreover, the fine grains preferably substantially do not contain screw dislocation. "Substantially do not contain" used herein has the same meaning as defined above.

The halide composition of the fine grains may be AgCl, AgBr, AgBrI (the content of $I^-$ is preferably 20 mol % or less and more preferably 10 mol % or less) and mixed crystals of two or more thereof.

The preparation method of the fine grains is described in detail below. In the first place, the process of nucleus formation is described.

(1) Nucleus Formation

First of all, an $AgX_1$ nucleus, that is, a host silver halide nucleus, is formed by reacting $Ag^+$ and halide ($X_1^-$) in a dispersion medium solution containing at least a dispersion medium and water. Subsequently, a different kind of $X_2^-$ solution or an impurity (yellow prussiate of potash and the like) is added and a dislocation which is the origin of the formation of the tabular grain is substantially formed. To form the dislocation of the present invention, the reaction conditions should be a {100} face-forming atmosphere. In addition, as the speed of the dislocation formation of the present invention is, in general, slow, the reaction system should be maintained as it is for a certain period of time (preferably 3 minutes or more, more preferably 7 minutes or more) without any new addition after the addition of the different kind of $X_2^-$ solution or the impurity.

As a crystal habit inhibitor necessary in the nucleus formation, the compounds disclosed in EP 0534395A1, gelatin of a high methionine content (preferably 10 μmol/g or more, more preferably from 30 to 200 μmol/g), and well-known water-soluble dispersion media for AgX emulsion (disclosures in *Research Disclosure*, Vol. 307, Item 307105, November, 1989, can be referred to regarding the whole, and the dispersion media disclosed in JP-B-52-16365, JP-A-59-8604, and *Journal of Imaging Science*, Vol. 31, pages 148 to 156 (1987) are particularly preferred) can be enumerated.

The temperature of the nucleus formation is preferably 20° to 80° C. and more preferably 25° to 50° C. The smaller size of the nucleus is convenient from a viewpoint of both easy ripening progress and forming thinner grains. Accordingly, the nucleus formation is preferably carried out at a low temperature. However, forming the dislocation of the present invention requires energy. For satisfying both, the formation of AgX nuclei is carried out at low temperature, and increasing the temperature preferably by 2° C. or more, preferably by 5° to 30° C. during dislocation formation, should be sufficient.

It is preferred to supply the silver halide fine grains, which are necessary for ripening, after introducing the dislocation of the present invention and before ripening. The halide composition to be added at this time is preferably $Cl^-$ so as not to dissolve the tabular grains formed and to easily carry out growth during ripening. Also, adding this halide can stop the introduction of the dislocation of the present invention.

Dislocation can be introduced into grains by halide gap or impurities, and when the number of the dislocation lines introduced into the grains is three or more, the grains finally obtained become thick grains growing accelerated to three directions of x, y and z axes and having a low aspect ratio. Herein, the x and y axes are parallel to the major face and orthogonal and the z axis is vertical to the major face. Accordingly, the frequency of the formation of thick grains is less, and it is good to control the amount of the dislocation formation so as to increase the frequency of the tabular grain formation. For such controlling, the kinds and added amounts of $X_2$ and impurities for the formation of the dislocation lines can be selected by trial and error. The kind and added amount of the halide for use in ripening and for stopping the introduction of the dislocation lines of the present invention also can be selected by trial and error.

(2) Ripening

It is difficult to form only the tabular grain nuclei selectively during nucleus formation. Accordingly, the grains other than the tabular grains are dissolved by Ostwald ripening in the succeeding ripening process. The ripening temperature is preferably higher than the nucleus formation temperature by 10° C. or more, generally at 50° to 90° C. Non-tabular grains are dissolved by ripening and deposited on the tabular grains. Fine grains having the composition and size to be more easily dissolved than the tabular grains are preferably present at the early stage of the ripening so that the tabular grains are not easily dissolved. Further, it is preferred that introducing a new dislocation line should not occur during ripening and, for such a purpose, it is preferred to let pass enough time after the addition of different halides or impurities to obtain an equilibrium condition or to reduce the effects of different halides and impurities as much as possible to nearly zero by the addition of a halide having the same composition as $AgX_1$.

Ripening is preferably not carried out to such a degree that all the fine grains vanish. The corners of the tabular grains are dissolved if all the fine grains vanish and there occur grains having an inferior anisotropic property. Therefore, it is preferred to begin growing while fine grains are present.

(3) Grain Growth

After the above described ripening, the tabular grains can be further grown to desired sizes as necessary. The methods therefor include 1) an ion addition method in which grains are grown by adding an $Ag^+$ salt solution and an $X^-$ salt solution under low supersaturated concentration, 2) a fine grain addition method in which grains are grown by adding previously formed AgX fine grains, and 3) a method combining 1) and 2). In each of the above methods, fine grains are preferably present.

The chemical sensitization conditions of the present invention are not particularly limited, but the pAg is from 6 to 11, preferably from 7 to 10, and the temperature is from 40° to 95° C., preferably from 45° to 85° C.

It is preferred to use a noble metal sensitizer such as gold, platinum, palladium, iridium, etc., in combination in the present invention. In particular, a combined use with a gold sensitizer is preferred such as, specificaily, chloroauric acid, potassium chloroaurate, potassium auric thiocyanate, gold sulfide, gold selenide, etc., which can be used in an amount of $10^{-7}$ to $10^{-2}$ mol/mol of Ag or so.

Further, a sulfur sensitizer is also preferably used in combination in the present invention. Specific examples thereof include well-known unstable sulfur compounds such as thiosulfate (e.g., hypo), thioureas (e.g., diphenylthiourea, triethylurea, allylthiourea), rhodanine, etc., which can be used in an amount of $10^{-7}$ to $10^{-2}$ mol/mol of Ag or so.

Further, a selenium sensitizer is also preferably used in combination in the present invention.

The unstable selenium sensitizers disclosed in JP-B-44-15748 preferably can be used, for example.

Specific examples of the unstable selenium sensitizers include compounds such as colloidal selenium, selenoureas (e.g., N,N-dimethylselenourea, selenourea, tetramethylselenourea), selenoamides (e.g., selenoacetamide, N,N-dimethylselenobenzamide), selenoketones (e.g., selenoacetone, selenobenzophenone), selenides (e.g., triphenylphosphine selenide, diethyl selenide), selenophosphates (e.g., tri-p-tolylselenophosphate), selenocarboxylic acid and esters thereof, isoselenocyanates, etc., which can be used in an amount of $10^{-8}$ to $10^{-3}$ mol/mol of Ag or so.

Further, it is preferred to carry out tellurium sensitization in the presence of a silver halide solvent in the present invention.

Specific examples of tellurium sensitizers include thiocyanate (e.g., potassium thiocyanate), thioether compounds (for example, the compounds disclosed in U.S. Pat. Nos. 3,021,215and 3,271,157, JP-B-58-30571, JP-A-60-136736, e.g., 3,6-dithia-1,8-octanediol), tetra-substituted thiourea compounds (for example, the compounds disclosed in JP-B-59-11892, U.S. Pat. No. 4,221,863, e.g., tetramethylthiourea), the thione compounds disclosed in JP-B-60-11341, the mercapto compounds disclosed in JP-B-63-29727, the mesoionic compounds disclosed in JP-B-60-163042, the selenoether compounds disclosed in U.S. Pat. No. 4,782,013, the telluroether compounds disclosed in JP-A-2-118566, sulfite, etc. Of these, thiocyanate, a thioether compound, a tetra-substituted thiourea compound and a thione compound preferably can be used. The amount added is $10^{-5}$ to $10^{-2}$ mol/mol of Ag or so.

Particularly preferred examples of usages and compounds are disclosed in detail, for example, in JP-A-3-116132, JP-A-5-113635, JP-A-5-165136, JP-A-5-165137, JP-A-5-134345, etc.

Particularly preferably used selenium sensitizers include Selenium Compounds I to X shown below. Particularly preferably used tellurium sensitizers include Tellurium Compounds I to X shown below.

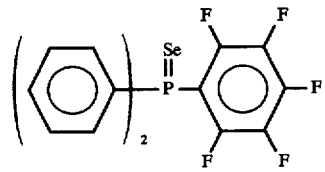

Selenium Compound I

KSeCN

Selenium Compound II

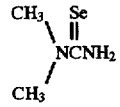

Selenium Compound III

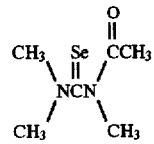

Selenium Compound IV

-continued

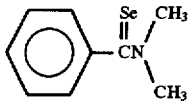

Selenium Compound V

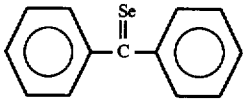

Selenium Compound VI

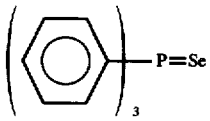

Selenium Compound VII

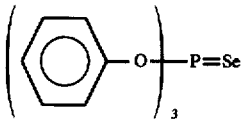

Selenium Compound VIII

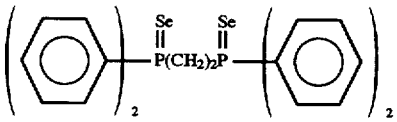

Selenium Compound IX

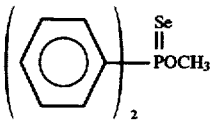

Selenium Compound X $((i)C_3H_7)_2PC_4H_9(i)$ Tellurium Compound I $((i)C_4H_9)_2PC_4H_9(n)$ Tellurium Compound II $((i)C_3H_7)_2PC_4H_9(n)$ Tellurium Compound III $((i)C_3H_7)_3P{=}Te$ Tellurium Compound IV $(i)C_3H_7P(C_4H_9(i))_2$ Tellurium Compound V $C_2H_5P{\leftarrow}N(CH_3)_2)_2$ Tellurium Compound VI $(C_2H_5)_2PN(C_2H_5)_2$ Tellurium Compound VII

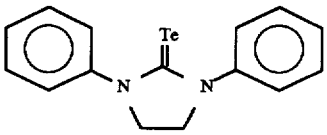

Tellurium Compound VIII

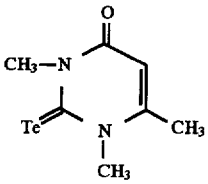

Tellurium Compound IX

-continued

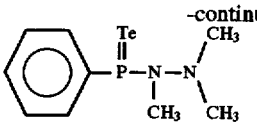

Tellurium Compound X

The emulsion for use in the present invention is preferably reduction sensitized. Reduction sensitization can be carried out, as disclosed in JP-A-2-191938, JP-A-2-136852 and JP-B-57-33572, using reduction sensitizers such as ascorbic acid and derivatives thereof, thiourea dioxide, stannous chloride, aminoiminomethanesulfinic acid, hydrazine derivative, a borane compound, a silane compound, and a polyamine compound. Reduction sensitization can be performed by carrying out ripening while maintaining a pH of 7 or more and a pAg of 8.3 or less. Reduction sensitization also can be carried out by introducing a single added part of a silver ion into the grains.

However, reduction sensitization using ascorbic acid and derivatives thereof or thiourea dioxide is preferred to lessen negative effects on grain formation and crystal growth and to perform controlled reduction sensitization. The amount to be used varies depending on the kind of sensitizers used but is preferably from $10^{-7}$ mol to $10^{-2}$ mol/mol of Ag. Reduction sensitization can be conducted at any stage during grain formation, and after grain formation but before chemical sensitization.

The above described accelerator for forming a {100} face can coexist during grain formation according to the above described regulation. The crystal habit inhibitor is a compound which reduces the above described potential of equilibrium crystal habit of the growing AgX grain by 10 mV or more, preferably by 30 to 200 mV, by coexistence. In this case, the grains can be obtained more easily.

With respect to specific examples, U.S. Pat. Nos. 4,399,215, 4,414,306, 4,400,463, 4,713,323, 4,804,621, 4,783,398, 4,952,491, and 4,983,508, *Journal of Imaging Science,* Vol. 33, page 13 (1989), ibid., Vol. 34, page 44 (1990), and *Journal of Photographic Science,* Vol. 36, page 182 (1988) can be referred to.

As most of the grains have {100} faces, adsorption of an adsorbing group in gelatin (e.g., a methionine group) to $Ag^+$ of the grain surface is strong. Therefore, the adsorption of spectral sensitizing dyes, antifoggants and other photographic additives sometimes are hindered. In such cases, dispersion medium gelatin having the most preferred methionine content can be selected. Specifically, average methionine content of gelatin in the AgX emulsion layer of the photographic material can be selected preferably from 0 to 50 μmol/g, more preferably from 3 to 30 μmol/g.

The AgX emulsion can be sensitized by adding a chemical sensitizer in an amount of $10^{-2}$ to $10^{-8}$ mol/mol of Ag and a sensitizing dye in an amount of preferably 5 to 100% of the saturated adsorbing amount.

Epitaxial grains may be formed and used at the edges and/or corners of grain using the grains obtained as host grains. Further, grains having dislocation lines inside the grains may be formed using the obtained grains obtained as cores. In addition, grains of various known grain constitutions can be made by making the tabular grains obtained as substrates and laminating AgX layers having halide compositions different from the substrates. With respect to these, literature described below can be referred to. Further, chemical sensitization specks are, in general, applied to the emulsion grains obtained.

In such a case, it is preferred to control the place of formation and the number/$cm^2$ of the chemical sensitization specks. With respect to this, JP-A-2-838, JP-A-2-146033, JP-A-1-201651, JP-A-3-121445, JP-A-64-74540, JP-A-4-308840, Japanese Patent Application No. Hei-3-140712 and JP-A-343348 can be consulted.

The AgX emulsion grains produced according to the method of the present invention can be blended with one or more other AgX emulsions. The blending ratio is from 1.0 to 0.01, and the optimal ratio can be selected arbitrarily.

The dissolution resistant antistatic agents preferably used in the present invention are described below.

"Dissolution resistant" used in the present invention means that a photographic material does not substantially dissolve when being processed using an automatic processor, specifically the amount dissolved is 1% or less based on the added amount.

Materials preferably used as electrically conductive materials in the present invention are crystalline metal oxide grains, and those with oxygen deficiency, those containing a small amount of different atoms which form a donor against the metal oxide used are preferred as, in general, they have high electric conductivity, and particularly the latter is preferred as they do not give fog to the silver halide emulsion. Preferred examples of the metal oxides include ZnO, $TiO_2$, $SnO_2$, $Al_2O_3$, $In_2O_3$, $SiO_2$, MgO, BaO, $MoO_3$, and $V_2O_5$ which are doped with impurities, or composite oxides of them, particularly ZnO, and $TiO_2$ and $SnO_2$ doped with impurities are preferred. As examples of the metal oxides containing different atoms, for example, adding of Al or In to ZnO, Sb, Nb, P and a halogen element to $SnO_2$, Nb and Ta to $TiO_2$ are effective. The added amount of these different atoms is preferably from 0.01 mol % to 30 mol %, particularly preferably from 0.1 mol % to 10 mol %. Further, silicone compounds may be added during grain formation for improving fine grain dispersion and transparency. The metal oxide fine grains for use in the present invention have electric conductivity and the volume resistivity is $10^7\Omega$/cm or less, particularly $10^5\Omega$/cm or less.

These oxides are disclosed in JP-A-56-143431, JP-A-56-120519 and JP-A-58-62647.

Further, as disclosed in JP-B-59-6235, electrically conductive materials prepared by adhering the above metal oxides on other crystalline metal oxide grains or fibrous materials (e.g., titanium oxide) may be used.

The grain size which can be used is preferably 1 μm or less, but when it is 0.5 μm or less, the stability after dispersion is good and the grains are easy to use. Further, when electrically conductive grains of sizes of 0.3 μm or less are used to reduce light scattering as far as possible, it becomes feasible to prepare a transparent photographic material. The lower limit of the grain size is not limited but good electric conductivity can be obtained when the grain size is 0.01 μm or more.

When the electrically conductive material is acicular or fibrous, preferably the length is 30 μm or less and the diameter is 1 μm or less, particularly preferably the length is 10 μm or less and the diameter is 0.3 μm or less, and the length/diameter ratio is 3 or more.

These metal oxide having electric conductivity of the present invention may be coated without a binder, and in such a case it is preferred to further coat a binder thereon.

The metal oxide of the present invention is more preferably coated with a binder. The binder is not particularly limited. For example, water-soluble binders such as gelatin, dextran, polyacrylamide, starch, and polyvinyl alcohol may be used, or synthetic polymer binders such as poly(meth) acrylate, polyvinyl acetate, polyurethane, polyvinyl chloride, polyvinylidene chloride, styrene/butadiene copolymer, polystyrene, polyester, polyethylene, polyethylene oxide, polypropylene, and polycarbonate may be used in an organic solvent. Further, these polymer binders may be used in the form of dispersion in water.

Spherical and fibrous metal oxides may be used in admixture.

The added amount of the metal oxide in the present invention is preferably from 0.0005 to 1 g/m$^2$, more preferably from 0.0009 to 0.5 g/m$^2$, and particularly preferably from 0.0012 to 0.3 g/m$^2$.

A heat resisting agent, a weather resisting agent, an inorganic grain, a water-soluble resin, and an emulsion may be added to the layer comprising metal oxide of the present invention for the purpose of matting and film quality improvement so long as the effect of the present invention is not adversely affected.

For example, inorganic fine grains may be added to the layer comprising the metal oxide of the present invention. Examples of inorganic fine grains to be added are silica, colloidal silica, alumina, alumina sol, caolin, talc, mica, calcium carbonate, etc. The average grain size of the fine grains is preferably from 0.01 to 10 μm, more preferably from 0.01 to 5 μm, and the amount is preferably from 0.05 to 10 parts, particularly preferably from 0.1 to 5 parts in weight ratio based on the solid part in the coating solution.

Various organic or inorganic hardening agents may be added to the coating agent of the present invention. They may be low or high molecular weight compounds and may be used alone or in combination.

The low molecular weight hardening agents disclosed, for example, in T. H. James, *The Theory of the Photographic Process,* 4th Ed., pages 77 to 88 are used in the present invention and, above all, those having vinylsulfonic acid, an aziridine group, an epoxy group, a triazine ring are preferred. The low molecular weight compounds disclosed in JP-A-53-41221 and JP-A-60-225143 are particularly preferred. High molecular weight hardening agents are compounds preferably having at least two or more groups, which react with hydrophilic colloid such as gelatin, in the same molecule and having a molecular weight of 2,000 or more. Groups which react with hydrophilic colloid such as gelatin include, for example, an aldehyde group, an epoxy group, active halide (e.g., dichlorotriazine, chloromethylstyryl, chloroethylsulfonyl), an active vinyl group, an active ester, etc.

Examples of high molecular weight hardening agents preferably used in the present invention include, for example, dialdehyde starch, polyacrolein, a polymer having an aldehyde group such as the acrolein copolymers disclosed in U.S. Pat. No. 3,396,029, the polymers having epoxy groups disclosed in U.S. Pat. No. 3,623,878, the polymers having dichlorotriazine groups disclosed in *Research Disclosure,* No. 17333 (1978), and the polymers having active esters disclosed in JP-A-56-66841, the polymers having active vinyl groups or precursors thereof disclosed in JP-A-56-142524, U.S. Pat. No. 4,161,407, JP-A-54-65033, *Research Disclosure,* No. 16725 (1978). In particular, those in which an active vinyl group or a precursor thereof is bonded to the principal chain of the polymer via a long spacer as disclosed in JP-A-56-142524 are preferred.

Electrically conductive polymers or latexes which are preferably used in the present invention are described below. Electrically conductive polymers used are not limited and may be anionic, cationic, betaine, or nonionic, but anionic and cationic polymers or latexes are preferred. More preferred are anionic sulfonic acid based, carboxylic acid based, and phosphoric acid based polymers or latexes, and tertiary amine based, quaternary ammonium based and phosphonium based polymers or latexes. Examples of these electrically conductive polymers include the anionic polymers and latexes disclosed in JP-B-52-25251, JP-A-51-29923 and JP-B-60-48024 and the cationic polymers and latexes disclosed in JP-B-57-18176, J-B-57-56059, JP-B-58-56856 and U.S. Patent 4,118,231.

Specific examples of these electrically conductive polymers and latexes are shown below, but the present invention is not limited thereto.

P-1

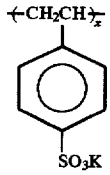

(average molecular weight: 150,000)

P-2

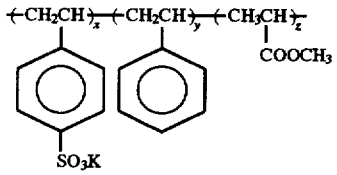

x/y/z = 25/60/15 (latex)

P-3

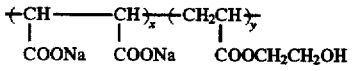

x/y = 70/30 (average molecular weight: 45,000)

P-4

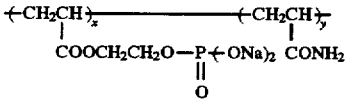

x/y = 50/50 (average molecular weight: 12,000)

P-5

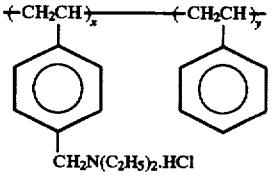

x/y = 30/70 (latex)

P-6

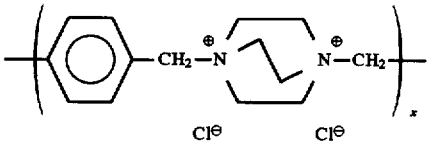

(average molecular weight: 10,000)

P-7

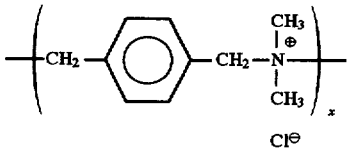

(average molecular weight: 30,000)

Metal oxides having excellent dissolution resistance to processing solutions are preferably used in the present invention.

These polymers or latexes having electric conductivity of the present invention may be coated without a binder, and in such a case it is preferred to further coat a binder thereon. The polymers or latexes having electric conductivity of the present invention is more preferably coated with a binder. The binder is not particularly limited, but the above described binders are preferably used. Further, a hardening agent can be coated with these binders and preferred examples thereof are the same as described above.

The amount used of the polymers or latexes having electric conductivity of the present invention is from 0.005 to 5 g/m$^2$, preferably from 0.01 to 3 g/m$^2$, and more preferably from 0.02 to 1 g/m$^2$. The amount used of the binders is from 0.005 to 5 g/m$^2$, preferably from 0.01 to 3 g/m$^2$, and particularly preferably from 0.01 to 2 g/m$^2$.

The ratio of the electrically conductive polymer or latex to the binder is from 99/1 to 10/90, preferably from 95/5 to 15/85, and particularly preferably from 90/10 to 20/80, by weight ratio.

The layers to which the electrically conductive metal oxides, polymers and latexes are added are not particularly limited provided that they are contained in the layers on the same side of the support as the emulsion layers. There can be cited, for example, a protective layer, an interlayer, an emulsion layer, an UV layer, an antihalation layer, and an undercoat layer. The preferred of these are a protective layer, an interlayer, an antihalation layer, and an undercoat layer, and the particularly preferred are an undercoat layer, an interlayer, and an antihalation layer.

An ultraviolet absorbing agent is described below.

Any known ultraviolet absorbing agent can be used in the present invention. Preferred ultraviolet absorbing agents are represented by the following formulas (I) to (VII):

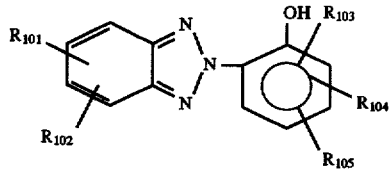

(I)

wherein $R_{101}$, $R_{102}$, $R_{103}$, $R_{104}$ and $R_{105}$, which may be the same or different, each represents a hydrogen atom, a halogen atom, an alkyl group, a cycloalkyl group, an alkyloxy group, an aryl group, an aryloxy group, an alkenyl group, a nitro group, a carboxyl group, a sulfonic acid group or a hydroxyl group.

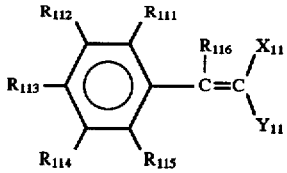

(II)

wherein $R_{111}$ to $R_{115}$, which may be the same or different, each represents a hydrogen atom, a halogen atom, an alkyl group, an aryl group, an alkyloxy group, an aryloxy group, an alkylthio group, an arylthio group, an amino group, an alkylamino group, a dialkylamino group, an arylamino group, a hydroxyl group, a cyano group, a nitro group, a carbamoyl group, an alkylcarbamoyl group, an arylcarbamoyl group, an alkylsulfonyl group, an arylsulfonyl group, a sulfamoyl group, an alkylsulfamoyl group, an arylsulfamoyl group, an alkylsulfonamido group, an arylsulfonamido group, a carboxyl group, a sulfonic acid group, an alkylcarbonyloxy group or an alkyloxycarbonyl group; $R_{116}$ represents a hydrogen atom or an alkyl group; $X_{11}$ and $Y_{11}$ represent a cyano group, —$COOR_{117}$, —$CONHR_{117}$, —$COR_{117}$, —$SO_2R_{117}$, or —$SO_2NHR_{117}$; and $R_{117}$ represents an alkyl group or an aryl group; $X_{11}$ and $Y_{11}$ may be linked to form a 5- to 7-membered ring.

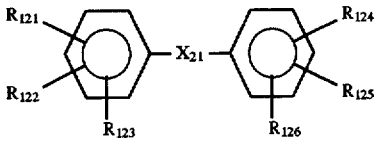

(III)

wherein $R_{121}$ to $R_{126}$, which may be the same or different, each represents a hydrogen atom, a halogen atom, an alkyl group, an aryl group, an alkyloxy group, an aryloxy group, an alkylthio group, an arylthio group, an amino group, a hydroxyl group, a cyano group, a nitro group, an alkylacylamino group, an arylacylamino group, an alkylcarbamoyl group, an arylcarbamoyl group, an alkylsulfonamido group, an arylsulfonamido group, an alkylsulfamoyl group, an arylsulfamoyl group, a carboxyl group, a sulfonic acid group, an alkylcarbonyloxy group or an alkyloxycarbonyl group; and $X_{21}$ represents —CO— or —COO—.

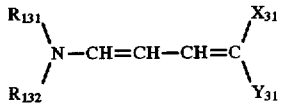

(IV)

wherein $R_{131}$ and $R_{132}$, which may be the same or different, each represents a hydrogen atom, an alkyl group, an aryl group, or a nonmetal atomic group necessary to form a 5- or 6-membered ring by linking with each other; $X_{31}$ and $Y_{31}$ may be the same or different and have the same meaning as $X_{11}$ and $Y_{11}$ in formula (II).

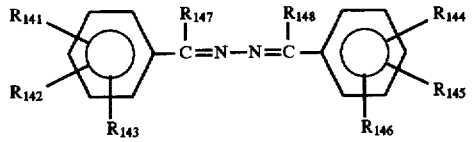

(V)

wherein $R_{141}$ to $R_{146}$ may be the same or different and have the same meaning as $R_{110}$ to $R_{114}$; and $R_{147}$ and $R_{147}$, which may be the same or different, each represents a hydrogen atom, an alkyl group or an aryl group.

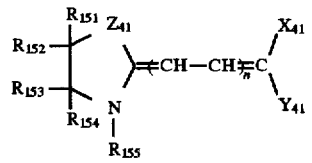

(VI)

wherein $R_{151}$ to $R_{154}$, which may be the same or different, each represents a hydrogen atom, an alkyl group or an aryl group, $R_{151}$ and $R_{154}$ may form a double bond conjointly, and when $R_{151}$ and $R_{154}$ form a double bond conjointly, $R_{152}$ and $R_{153}$ may be linked to form a benzene ring or a naphthalene ring; $R_{155}$ represents an alkyl group or an aryl group; $Z_{41}$ represents a hydrogen atom, a sulfur atom, an ethylene group, =N—$R_{156}$ or =C($R_{157}$)($R_{158}$); $R_{156}$ represents an alkyl group or an aryl group; $R_{157}$ and $R_{158}$, which may be the same or different, each represents a hydrogen atom or an alkyl group, and $R_{157}$ and $R_{158}$ may be linked to form a 5- or 6-membered ring; n represents 0 or 1; and $X_{41}$ and $Y_{41}$, which may be the same or different, each has the same meaning as $X_{11}$ and $Y_{11}$ in formula (II).

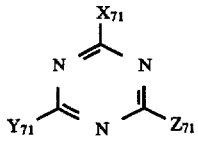

(VII)

wherein $X_{71}$, $Y_{71}$ and $Z_{71}$ each independently represents a substituted or unsubstituted alkyl, aryl, alkyloxy, aryloxy or heterocyclic group, provided that at least one of $X_{71}$, $Y_{71}$ and $Z_{71}$ represents the following formula (VIII):

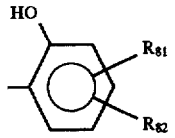

(VIII)

wherein $R_{81}$ and $R_{82}$ each independently represents a hydrogen atom, a halogen atom, a substituted or unsubstituted alkyl, cycloalkyl, aryl, alkyloxy, or aryloxy group.

Among the groups represented by $R_{101}$ to $R_{105}$, $R_{111}$ to $R_{117}$, $R_{121}$ to $R_{126}$, $R_{131}$, $R_{132}$, $R_{141}$ to $R_{148}$, $R_{151}$ to $R_{155}$, $R_{81}$, $R_{82}$, $X_{71}$, $Y_{71}$ and $Z_{71}$ in formulae (I) to (VIII), the alkyl group preferably has from 1 to 20 carbon atoms, and may have a substituent [for example, a hydroxyl group, a cyano group, a nitro group, a halogen atom (e.g., chlorine, bromine, fluorine), an alkoxy group (e.g., methoxy, ethoxy, butoxy, octyloxy), an aryloxy group (e.g., phenoxy), an ester group (e.g., methoxycarbonyl, ethoxycarbonyl, octyloxycarbonyl, dodecyloxycarbonyl), a carbonyloxy group (e.g., ethylcarbonyloxy, heptylcarbonyloxy, phenylcarbonyloxy), an amino group (e.g., dimethylamino, ethylamino, diethylamino), an aryl group (e.g., phenyl), a carbonamido group (e.g., methylcarbonylamido, phenylcarbonylamido), a carbamoyl group (e.g., unsubstituted carbamoyl, methylcarbamoyl, ethylcarbamoyl, phenylcarbamoyl), a sulfonamido group (e.g., methanesulfonamido, benzenesulfonamido), a sulfamoyl group (e.g., butylsulfamoyl, phenylsulfamoyl, methyloctylaminosulfonyl), a cyano group, a carboxyl group, a sulfonic acid group]. Specifically, groups such as methyl, ethyl, propyl, isopropyl, butyl, sec-butyl, t-butyl, pentyl, t-pentyl, hexyl, octyl, 2-ethylhexyl, t-octyl, decyl, dodecyl, hexadecyl, octadecyl, benzyl, phenethyl, and these groups having the above substituents can be cited.

Specific examples of the cycloalkyl group include cyclopropyl, cyclopentyl, cyclohexyl, bicyclo[2,2,2]octyl groups and these groups substituted with the above described substituents for the alkyl group.

The aryl group preferably has from 6 to 10 carbon atoms and may have a substituent [for example, an alkyl group (e.g., methyl, ethyl, propyl, isopropyl, butyl, sec-butyl, t-butyl, pentyl, t-pentyl, octyl, decyl, dodecyl, tetradecyl, hexadecyl), and the above described substituents for the alkyl group]. Specific examples of the aryl group include a phenyl group and a naphthyl group.

Specific examples of the alkenyl group include 2-butenyl, 3-butenyl and oleyl groups, and these groups may be substituted with the above described substituents for the alkyl group.

A 5- or 6-membered heterocyclic group having at least one of a nitrogen atom, an oxygen atom or a sulfur atom is preferred as the heterocyclic group, and the heterocyclic group may have the above described substituents for the alkyl group and the alkyl groups described above as the substituents for the aryl group. Specifically, groups such as a piperidine ring, a pyrrolidine ring, a morpholine ring, a furan ring, a tetrahydrofuran ring, a thiophene ring, a pyrrole ring, a pyrazole ring, a benzimidazole ring, a benzoxazole ring, a benzothiazole ring, a benzotriazole ring, a triazine ring, an indolenine ring, an indole ring, a tetrazole ring, an isooxazolone ring, and these groups having the above described substituents.

Examples of the 5- to 7-membered ring formed by the linkage of $X_{11}$ and $Y_{11}$ include groups such as rhodanine, hydantoin, thiazolidinedione, isooxazolone, pyrazolidinedione, indandione, and these groups having the substituents described above for the heterocyclic group.

Examples of the 5- to 6-membered ring formed by the linkage of $R_{157}$ and $R_{158}$ include a cyclopentane ring and a cyclohexane ring.

The halogen atoms represented by $R_{101}$ to $R_{105}$, $R_{111}$ to $R_{115}$, $R_{121}$ to $R_{126}$, $R_{81}$ and $R_{82}$ are chlorine, bromine and fluorine.

Specific examples of the ultraviolet absorbing agents represented by formulae (I) to (VI) are shown below, but the present invention is not limited thereto.

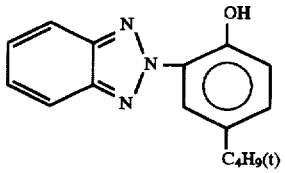

I-1

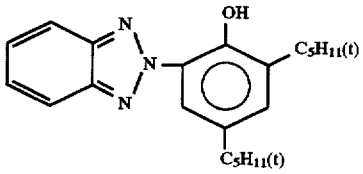

I-2

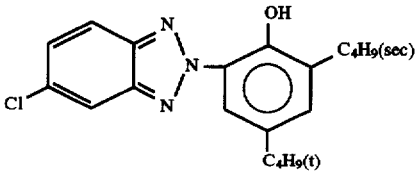

I-3

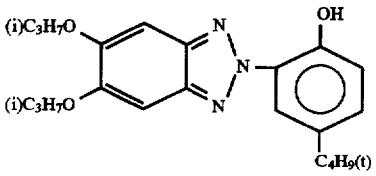

I-4

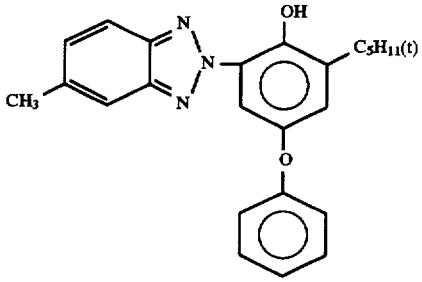

I-5

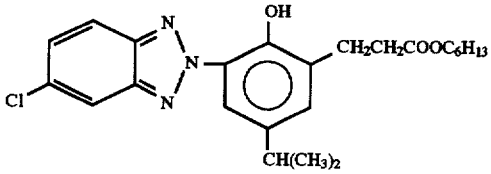

I-6

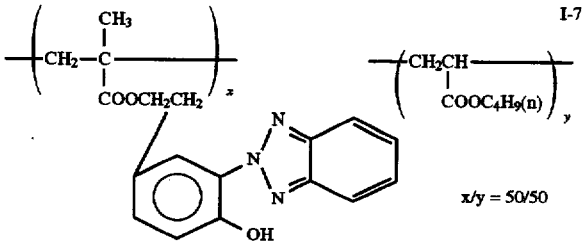

I-7

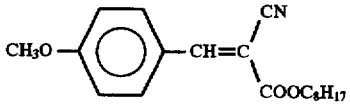

II-1

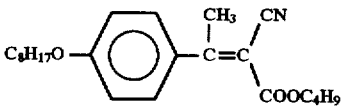

II-2

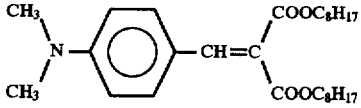

II-3

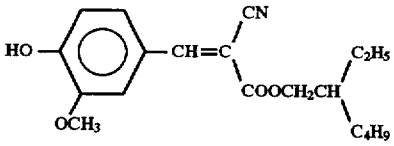

II-4

-continued
II-5
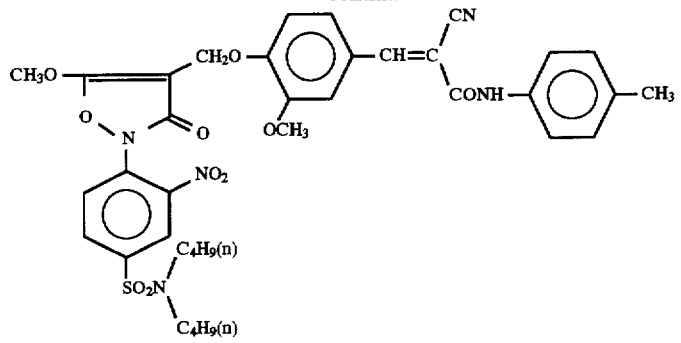
II-6
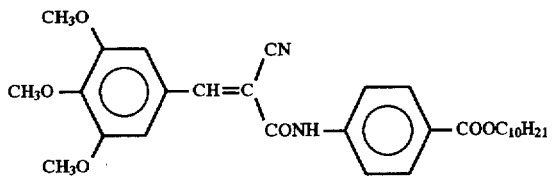
II-7
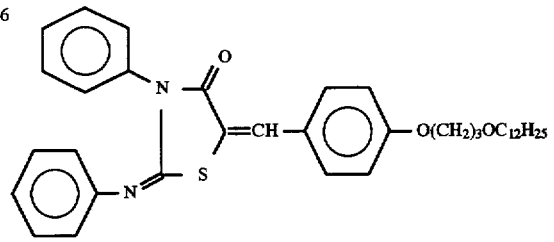
II-8
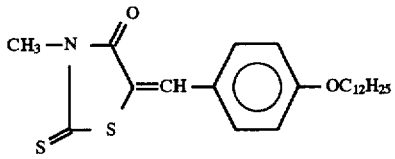
II-9
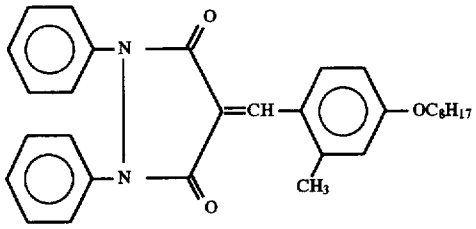
II-10
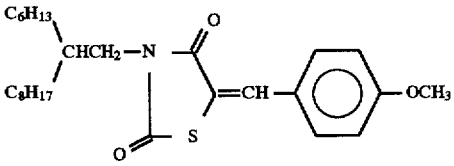
II-12
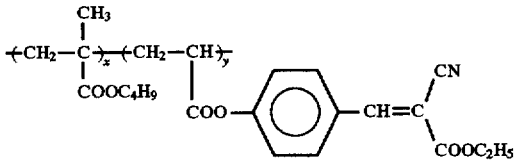
x:y = 30:70 (wt %)
II-13
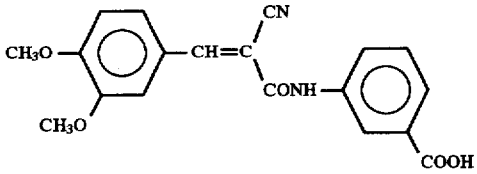
III-1
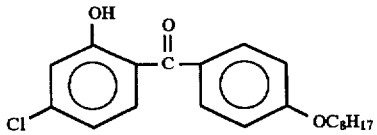
III-2
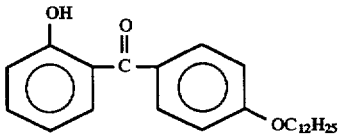
III-3
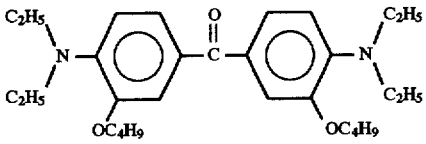
III-4
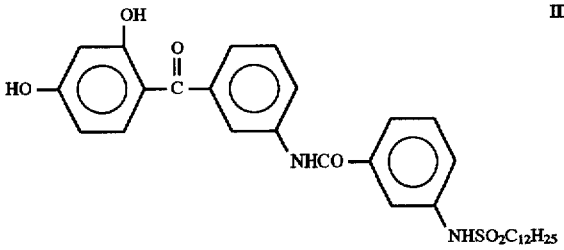
III-5
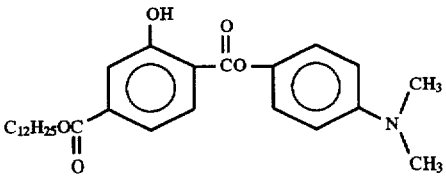

-continued

IV-1

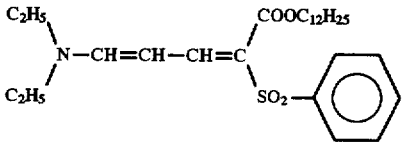

IV-2

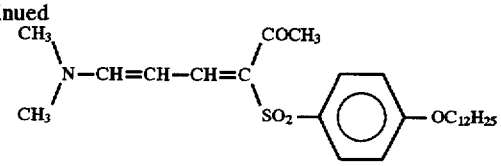

IV-3

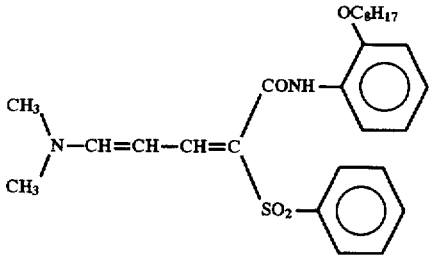

V-1

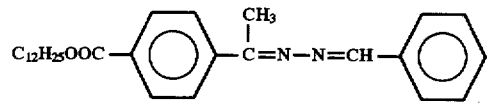

V-2

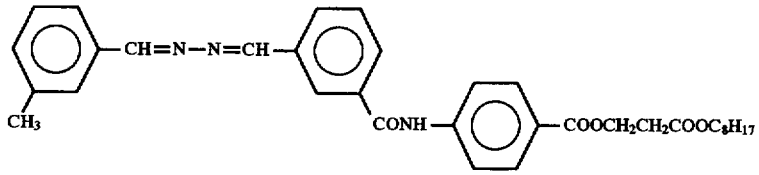

VI-1

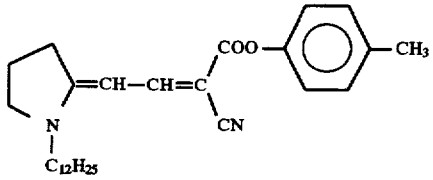

VI-2

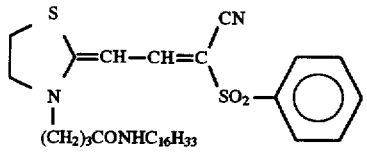

VI-3

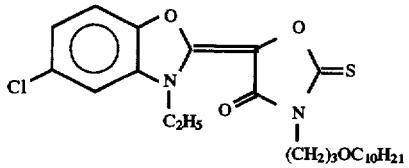

VI-4

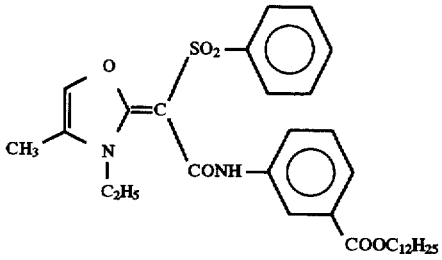

2-(2'-Hydroxyphenyl)benzotriazole based ultraviolet absorbing agents represented by formula (I) which are used in the present invention may be solid or liquid at normal temperature but liquid is preferred. Specific examples of the liquids are disclosed in JP-B-55-36984, JP-B-55-12587 and JP-A-58-214152. Detailed descriptions of ultraviolet absorbing agents represented by formula (I) are disclosed in JP-A-58-221844, JP-A-59-46646, JP-A-59-109055, JP-A-6-82962, JP-B-36-10466, JP-B-42-26187, JP-B-48-5496, JP-B-48-4.1572, U.S. Pat. Nos. 3,754,919 and 4,220,711.

Ultraviolet absorbing agents represented by formula (II) can be synthesized according to the methods disclosed in JP-B-48-31255, JP-B-50-10726, U.S. Pat. Nos. 2,719,086, 3,214,463, 3,284,203 and 3,698,707, or corresponding methods thereto.

Ultraviolet absorbing agents represented by formula (III) can be synthesized according to the methods disclosed in U.S. Pat. No. 3,707,375, JP-B-48-30492, JP-A-47-10537, JP-A-58-111942, JP-A-59-19945 and JP-A-63-53544, or corresponding methods thereto.

Ultraviolet absorbing agents represented by formula (IV) can be synthesized according to the methods corresponding to the methods disclosed in JP-A-51-56620, JP-A-53-128333 and JP-A-58-181040.

Ultraviolet absorbing agents represented by formula (V) can be synthesized according to the methods disclosed in British Patent 1,198,337 and JP-A-63-53544 or corresponding methods thereto.

Ultraviolet absorbing agents represented by formula (VI) can be synthesized according to the methods disclosed in U.S. Pat. No. 4,360,588 and JP-A-63-53544 or corresponding methods thereto.

Ultraviolet absorbing agents represented by formula (VII) can be synthesized according to the methods corresponding to the methods disclosed in JP-A-46-3335 and EP 520938A1.

VII-1
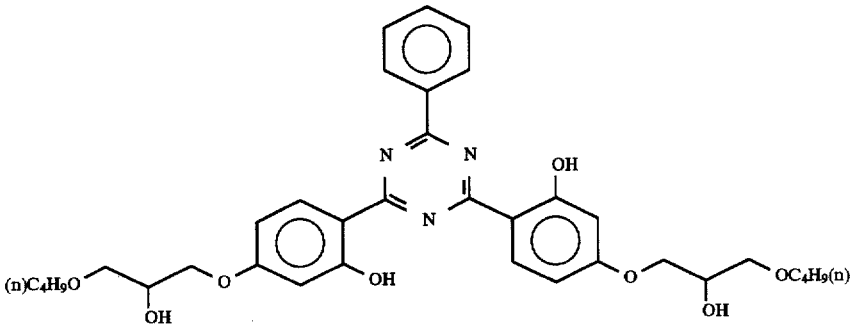
VII-2
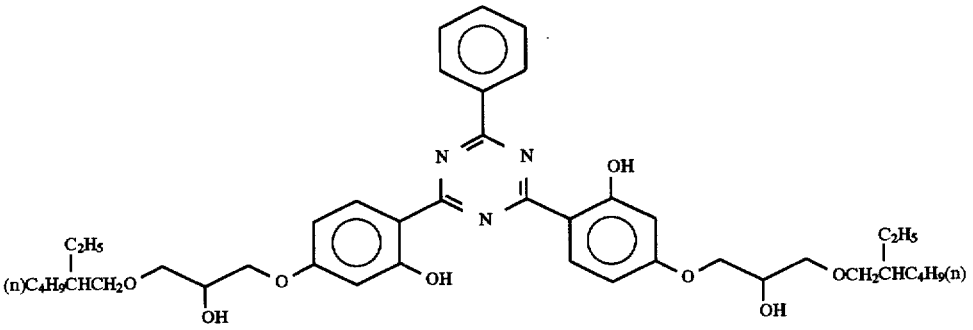
VII-3
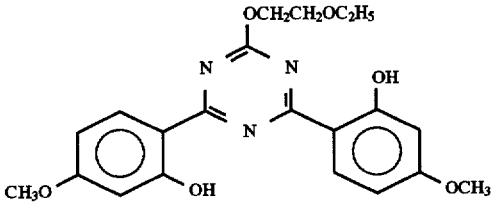
VII-4
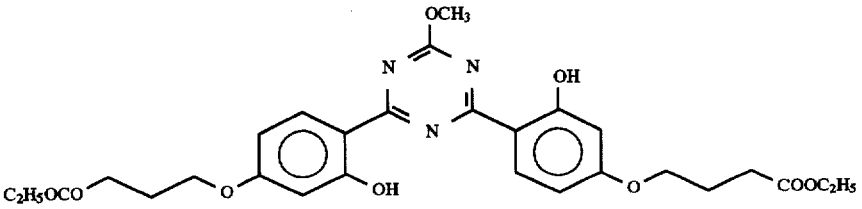
VII-5
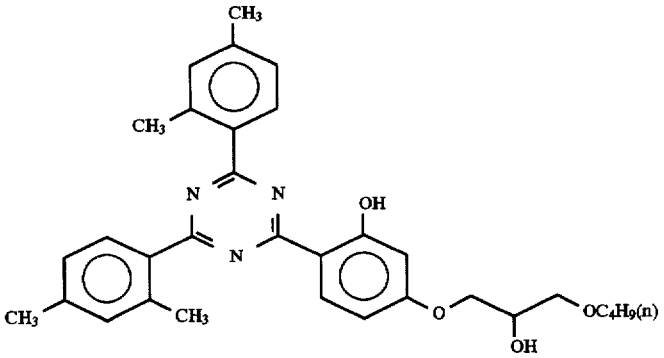

-continued

VII-6

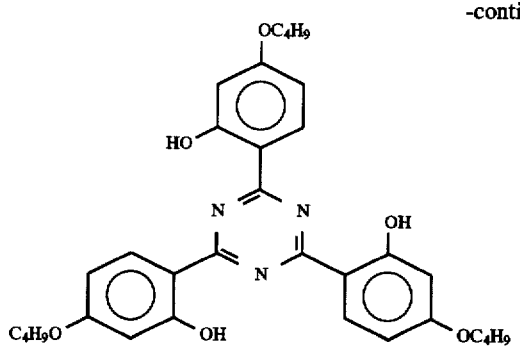

VII-7

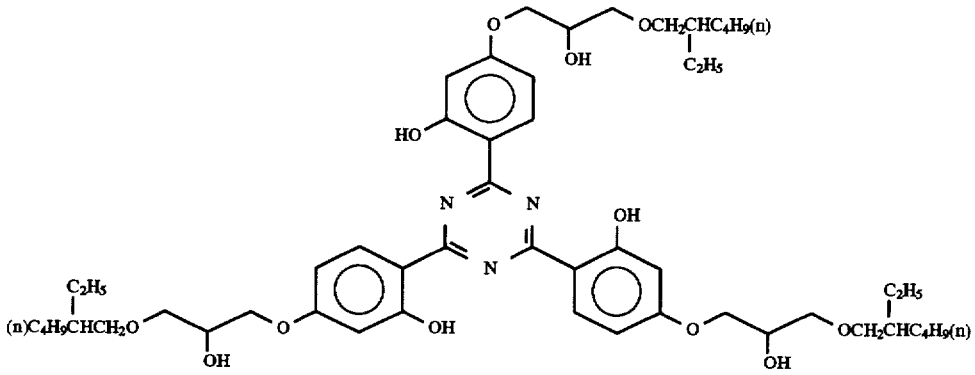

VII-8

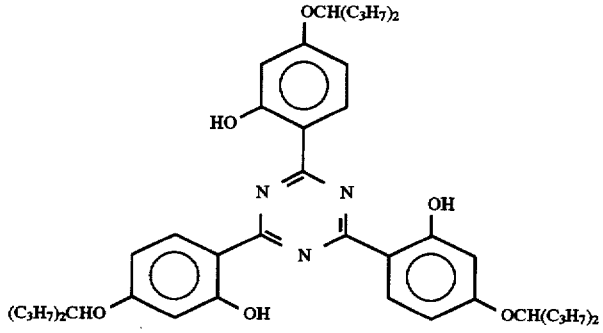

VII-9

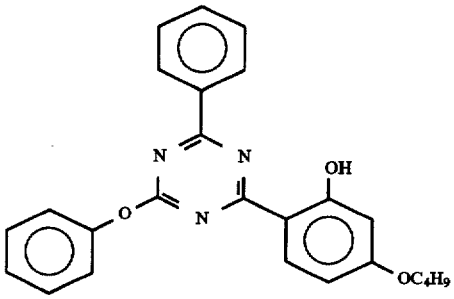

These ultraviolet absorbing agents can be used as solid dispersions of fine powders (fine crystalline grains). These solid dispersions of fine (crystal) grains can be produced mechanically by known pulverizing methods (e.g., using a ball mill, a vibrating ball mill, a planetary ball mill, a sand mill, a colloid mill, a jet mill, a roller mill) using an appropriate solvent, if necessary, in the presence of a dispersant (e.g., water, alcohol). Further, the fine (crystal) grains of the ultraviolet absorbing agents can be produced by employing the method of, after dissolving the ultraviolet absorbing agents in an appropriate solvent using a surfactant for dispersion, adding to a poor solvent for the ultraviolet absorbing agent to deposit crystallites, or the method of controlling the pH to dissolve the ultraviolet absorbing agent, then varying the pH to microcrystallize. The layer containing the fine powders of the ultraviolet absorbing agent can be prepared by dispersing the thus-obtained fine (crystal) grains of the ultraviolet absorbing agent into an appropriate binder to prepare a solid dispersion of almost uniform grains, and coating this dispersion on a support. The layer also can be prepared by the method of coating the ultraviolet absorbing agent in a dissociation state in the form of a salt, then overcoating acid gelatin to obtain dispersion fixation at the time of coating.

The above described binders are not particularly limited if the binders are hydrophilic colloid which can be used for a light-sensitive emulsion layer and a light-insensitive layer but, in general, gelatin or synthetic polymers are used. Known surfactants can be used as a surfactant for dispersion and anionic, nonionic and amphoteric surfactants are preferred. In particular, the use of anionic and/or nonionic surfactants is preferred.

The average grain size of the fine grains of the ultraviolet absorbing agent in the solid dispersion is from 0.005 μm to 10 μm, preferably from 0.01 μm to 1 μm, and still more preferably from 0.01 μm to 0.5 μm.

The ultraviolet absorbing agents of the present invention also can be used by dissolving in water or in an appropriate organic solvent miscible with water, such as alcohols (e.g., methanol, ethanol, propanol, fluorinated alcohol), ketones (e.g., acetone, methyl ethyl ketone), dimethylformamide, dimethyl sulfoxide and methyl cellosolve.

Further, the ultraviolet absorbing agents of the present invention can be used in the form of an emulsion dispersion mechanically prepared according to well known emulsifying dispersion methods by dissolving using oils such as dibutyl phthalate, tricresyl phosphate, glyceryl triacetate or diethyl phthalate, or polymers such as polybutyl acrylamide, and auxiliary solvents such as ethyl acetate and cyclohexanone, or they can be used in the form of a dispersion prepared according to the method knowh as solid dispersion in which powders of hydrazine derivatives are dispersed in water using a bail mill, a colloid mill or ultrasonic waves.

Further, the ultraviolet absorbing agents of the present invention can be used in the form of a dispersion by the micelle dispersion method disclosed in JP-A-63-23738.

The places to which the ultraviolet absorbing agents of the present invention are added are not particularly limited, and there can be cited, for example, gelatin layers such as an emulsion layer, an interlayer, or an undercoat layer, or in a support.

The added amount of the ultraviolet absorbing agent is from 1 to 500 mg/m$^2$, and particularly preferably from 3 to 100 mg/m$^2$.

The photographic material of the present invention may comprise two or more emulsion layers on a support, and the emulsion contained in each layer is desirably one kind or more, preferably from one kind to five kinds, and more preferably from one kind to three kinds. The silver amount in each layer is preferably from 10% to 90%, more preferably from 20% to 80%, of the silver coating amount contained in the entire emulsion layers on the same side of the support. It is preferred that, of the optional two layers provided on the same side of the support, the sensitivity of the farther layer from the support be lower than that of the nearer layer to the support. The difference in sensitivity of the two layers is preferably 20% or more, more preferably 30% or more, and still more preferably from 60% to less than 500%.

The sensitivity can be obtained from the reciprocal of the exposure amount giving optical density of fog +0.1 of single sensitometry characteristic of each layer.

The highest sensitivity emulsion of the photographic material of the present invention is preferably contained in the layers other than the farthest layer from the support. The total amount of silver of the highest sensitivity emulsion contained in the photographic material of the present invention is from 20% to 80%, preferably from 30% to 70%, of the total silver amount in the photographic material. Further, when the highest sensitivity emulsion is contained in both the farthest layer from the support and the other layer, if the proportion of the highest sensitivity emulsion contained in the farthest layer to the entire highest sensitivity emulsion is less than 50%, such a photographic material is included as an embodiment of the present invention.

When the photographic material of the present invention comprises two emulsion layers on one side of the support, it is preferred that the highest sensitivity emulsion is contained in the emulsion layer nearer to the support and the sensitivity of this emulsion layer is higher than that of the emulsion layer farther from the support.

Further, when a first emulsion layer, a second emulsion layer and a third emulsion layer are provided on the support in this order from the support, the sensitivity of the first emulsion layer may be higher than those/that of the second and/or the third emulsion layers. Of course, such a layer constitution may be provided on both sides of the support.

PEN is preferably used as a support of the photographic material but the present invention is not limited thereto.

The preferred PEN is polyethylene-2,6-naphthalate.

The polyethylene-2,6-naphthalate in the present invention is sufficient if its repeating structural unit is substantially constituted of an ethylene-2,6-naphthalenedicarboxylate unit, and includes not only polyethylene-2,6-naphthalenedicarboxylate not copolymerized but also copolymers 10% or less, preferably 5% or less, of the number of the repeating structural units are modified with another component, and the mixture with other polymers and compositions.

Polyethylene-2,6-naphthalate is synthesized by combining naphthalene-2,6-dicarboxylic acid or functional derivatives thereof with ethylene glycol or functional derivatives thereof in the presence of a catalyst under appropriate reaction conditions. The polyethylene-2,6-naphthalate in the present invention may be the product produced as copolymer a or a mixed polyester by adding one, two or more suitable third components (modifiers) before completion of the polymerization of the polyethylene-2,6-naphthalate. As the suitable third components, there can be cited a compound having a divalent ester-forming functional group, e.g., dicarboxylic acid such as oxalic acid, adipic acid, phthalic acid, isophthalic acid, terephthalic acid, naphthalene-2,7-dicarboxylic acid and succinic acid and diphenyl ether dicarboxylic acid, or the lower alkyl ester thereof; oxycarboxylic acid such as p-oxybenzoic acid and p-oxyethoxy-benzoic acid, or the lower alkyl ester thereof; or dihydric alcohol such as propylene glycol and trimethylene glycol. Polyethylene-2,6-naphthalate or a modified polymer thereof may be those with the terminal hydroxyl group and/or carboxyl group masked with a monofunctional compound such as, for example, benzoic acid, benzoylbenzoic acid, benzyloxy-benzoic acid, or methoxypolyalkylene glycol, or may be those modified with a trace amount of trifunctional or tetra-functional ester-forming compound such as glycerin, or pentaerythritol capable of obtaining a substantially linear copolymer.

When the photographic material of the present invention comprises on both sides of the support at least one silver halide emulsion layer each, the effect of the present invention is particularly displayed.

When the present invention is applied to such a photographic material having emulsion layers on both sides of the support, in addition to the above described effects, images of high quality and sharpness can be obtained. Further, when the replenishment rate during development processing is reduced, the tanks and rollers are not contaminated which is an unexpected effect.

A gold sensitization method using gold compounds, a sensitization method using metals such as iridium, platinum, rhodium, palladium and the like, a sulfur sensitization method using sulfur-containing compounds, a reduction sensitization method using stannous salts or polyamine, a sensitization method using selenium compounds, a sensitization method using tellurium compounds, or two or more of these methods in combination can be used as chemical sensitization methods. Silver halide tabular grains can be prepared by arbitrarily combining the methods known in the art.

The silver amount of the photographic material of the present invention is preferably from 0.5 $g/m^2$ to 5 $g/m^2$ (on one side) and more preferably from 1 $g/m^2$ to 3.4 $g/m^2$ (on one side).

For optimum rapid processing, it is preferred not to exceed 5 $g/m^2$.

The photographic material of the present invention preferably can be used in X-ray-photographing using, for example, the following fluorescent substance as a fluorescent intensifying screen.

Blue Emission Fluorescent Substance $Y_2O_2S$:tb, LaOBr:tb, BaFCl:Eu

Green Emission Fluorescent Substance $Gd_2O_2$:Tb, $LaO_2S$:Tb

UV Emission Fluorescent Substance

Hafnium-zirconium-germanate phosphor not containing titanium disclosed in JP-A-6-11804, $YTaO_4$, $YTaO_4$:Nb The various additives for use in the photographic material of the present invention are not particularly limited and, for example, those disclosed in the following corresponding places can be used.

| | |
|---|---|
| 1) Silver halide emulsion and the preparation method | from 6 lines up from the bottom, right lower column, page 8 to line 12, right upper column, page 10 of JP-A-2-68539; from line 10, right lower column, page 2 to line 1, right upper column, page 6 of JP-A-3-24537; from line 16, left upper column, page 10 to line 19, left lower column, page 11 of JP-A-3-24537; and JP-A-4-107442. |
| 2) Chemical sensitization method | from line 13, right upper column, page 10 to line 16, left upper column, page 10 of JP-A-2-68539; and JP-A-3-105035. |
| 3) Antifoggant and stabilizer | from line 17, left lower column, page 10 to line 7, left upper column, page 11 of JP-A-2-68539; and from line 2, left lower column, page 3 to left lower column, page 4 of JP-A-2-68539. |
| 4) Tone improving agent | line 7, left lower column, page 2 to line 20, left lower column, page 10 of JP-A-62-276539; and line 15, left lower column, page 6 to line 19, right upper column, page 11 of JP-A-3-94249. |
| 5) Spectral Sensitizing dye | from line 4, right lower column, page 4 to right lower column, page 8 of JP-A-2-68539. |
| 6) Surfactant and antistatic agent | from line 14, left upper column, page 11 to line 9, left upper column, page 12 of JP-A-2-68539. |
| 7) Matting agent, sliding agent and plasticizer | line 10, left upper column, page 12 to line 10, right upper column, page 12 of JP-A-2-68539; and line 10, left lower column, page 14 to line 1, right lower column, page 14 of JP-A-2-68539. |
| 8) Hydrophilic colloid | from line 11, right upper column, page 12 to line 16, left lower column, page 12 of JP-A-2-68539. |
| 9) Hardening agent | from line 17, left lower column, page 12 to line 6, right upper column, page 13 of JP-A-2-68539. |
| 10) Support | from lines 7 to 20, right upper column, page 13 of JP-A-2-68539. |
| 11) Crossover cut method | from line 20, right upper column, page 4 to right upper column, page 14 of JP-A-2-264944. |
| 12) Dye and mordant | line 1, left lower column, page 13 to line 9, left lower column, page 14 of JP-A-2-68539; and from left lower column, page 14 to right lower column of JP-A-3-14537. |
| 13) Polyhydroxybenzenes | from left upper column, page 11 to left lower column, page 12 of JP-A-3-39948; and EP 452772A. |
| 14) Layer constitution | JP-A-3-198041. |
| 15) Development processing method | from line 7, right upper column, page 16 to line 15, left lower column, page 19 of JP-A-2-103037; and from line 5, right lower column, page 3 to line 10, right upper column, page 6 of JP-A-2-115837. |

As the method of forming images using the photographic material of the present invention, a method of forming images in combination with a fluorescent substance having a main peak preferably at 400 nm or less, more preferably at 380 nm or less, is preferred.

A screen having a main emission peak at 400 nm or less is disclosed in JP-A-6-11804 and WO 93/01521, but the present invention is not limited thereto.

The emission wavelength of the fluorescent substance for use in the present invention is preferably 400 nm or less and more preferably 370 nm or less.

Representative fluorescent substances are compounds added with M' phase $YTaO_4$ alone or of M' phase $YT_aO_4$ added with Gd, Bi, Pb, Ce, St, Al, Rb, Ca, Cr, Cd or Nb, compounds of LaOBr added with Gd, Tm, Gd and Tm, Gd and Ce or Tb, compounds of HfZr oxide alone or of HfZr oxide added with Ge, Ti or alkali metal, compounds of $Y_2O_3$ alone or of $Y_2O_3$ added with Gd, Eu or compounds of $Y_2O_3$ added with Gd, and compounds of matrixes of various fluorescent substances added with Gd, Tl or Ce as an activator. Particularly preferred compounds are compounds of M' phase $YTaO_4$ alone or of M' phase YTaO added with Gd or Sr, compounds of LaOBr added with Gd, Tm or Gd and Tm, and compounds of HfZr oxide or of HfZr oxide added with Ge, Ti alkali metal.

The grain size of the fluorescent substance is preferably from 1 μm to 20 μm, but it can be changed according to the required sensitivity and manufacturing conditions. The coating amount is preferably from 400 $g/mm^2$ to 2,000 $g/mm^2$ but is varied depending on the required sensitivity and image quality and cannot be decided unconditionally. Further, grain sizes may be distributed by one sheet of intensifying screen from the vicinity of the support to the surface. In this case, in general, the grain size in the surface is larger than that in the vicinity of the support. The space filling rate of the fluorescent substance is 40% or more and preferably 60% or more.

When photographing with fluorescent layers disposed on both sides of the photographic material, the coating amounts of the fluorescent substance on the X-ray incidence side and the opposite side can be varied. When high sensitivity system is particularly required due to interception by the intensifying screen on the X-ray incidence side, it is known to reduce the coating amount on the intensifying screen on the X-ray incidence side.

Paper, a metal plate, a polymer sheet are used as the support for the fluorescent intensifying screen for use in the present invention but, in general, a flexible sheet such as polyethylene terephthalate is used. A reflecting agent or a light absorbing agent may be added to the support, if necessary, or may be included in a separate layer provided on the surface. Further, minute concavities and convexities can be given to the surface of the support, or an adhesive layer and a conductive layer can be undercoated for the purpose of increasing the adhesive strength with the fluorescent layers, if necessary. There are zinc oxide, titanium oxide, barium sulfate, etc., as a reflecting agent, and titanium oxide and barium sulfate are preferred because the emission wavelength of the fluorescent substance is short. A reflecting agent may be contained not only in the support or between the support and the fluorescent layer but also in the fluorescent layer. When a reflecting agent is contained in the fluorescent layer, it is preferred to be present richly in the vicinity of the support.

As binders for use in the present invention, there are natural high polymer such as protein, e.g., gelatin, polysaccharide, e.g., dextran and corn starch, and gum arabic; synthetic high polymer such as polyvinyl butyral, polyvinyl acetate, polyurethane, polyalkyl acrylate, vinylidene chloride, nitro cellulose, fluorine-containing polymer and polyester, and mixtures and copolymers of these materials. The binder having high transmission to the emission from the fluorescent substance as a fundamental performance is preferred. With respect to this point, gelatin, corn starch, acryl based polymer, fluorine-containing olefin polymer, polymer comprising olefin copolymer containing a little amount of fluorine, and styrene/acrylonitrile copolymer are preferred. These binders may contain a functional group crosslinked by a crosslinking agent. Further, according to the required performance of the image quality, an absorbing agent to the emission from the fluorescent substance may be included in the binder, or a binder having low transmission may be used. A pigment, a dye, and an ultraviolet absorbing compound are used as the absorbing agent. The ratio of the fluorescent substance to the binder is, in general, from 1/5 to 50/1, preferably from 1/1 to 15/1, in volume ratio. The ratio of the fluorescent substance to the binder may be uniform or may be nonuniform to the thickness direction.

The fluorescent layer is usually formed by coating a coating solution of a fluorescent substance dispersed in a binder solution. As a solvent for the coating solution, water or alcohol, organic solvent such as chlorine-containing hydrocarbon, ketone, ester, aromatic ether, and mixtures of these can be cited.

A dispersion stabilizer such as the phthalic acid, stearic acid, caproic acid of the grain of the fluorescent substance and a surfactant, and a plasticizer such as phosphate, phthalate, glycolic acid ester, polyester, and polyethylene glycol may be added to the coating solution.

A protective layer can be provided on the fluorescent layer of the present invention. The protective layer is usually formed by coating on the fluorescent layer, or laminating the protective layer prepared separately. In the coating method, the protective layer may be coated simultaneously with the fluorescent layer, or may be coated after coating and drying the fluorescent layer. The material of the protective layer may be the same as the binder of the fluorescent layer or may be different. As the materials used for the protective layer, other than the materials for the binder of the fluorescent layer, cellulose derivatives, polyvinyl chloride, melamine, phenol resin and epoxy resin are enumerated. Examples of preferred materials include gelatin, cornstarch, acryl based polymer, fluorine-containing olefin polymer, polymer comprising olefin copolymer containing a little amount of fluorine, and styrene/acrylonitrile copolymer. The thickness of the protective layer is usually from 1 μm to 20 μm, preferably from 2 μm to 10 μm, and more preferably from 2 μm to 6 μm. The surface of the protective layer of the present invention is preferably embossed. In addition, the protective layer may contain a matting agent, or a material having a light scattering property to emission, e.g., titanium oxide, according to images required.

The protective layer of the present invention may be given a surface sliding property. Preferred sliding agents are polysiloxane skeleton-containing oligomer and perfluoroalkyl group-containing oligomer.

The protective layer of the present invention may be given an electric conductivity. There are white and transparent inorganic electrically conductive material and organic antistatic agents as electric conductivity imparting agents. ZnO powders, whiskers, $SnO_2$ and ITO are preferred as inorganic electrically conductive materials.

The processing solutions preferably used in the present invention are described below.

The replenishment rate of the processing solution is preferably 10 cc or less per a quarter size sheet and more preferably 5 cc or less per a quarter size sheet, when the effect is larger.

A processing solution using ascorbic acids or derivatives thereof as a developing agent is preferably used in the present invention.

The compound represented by formula (I) disclosed in JP-A-5-165161 and the exemplary compounds I-1 to I-8 and II-9 to II-12 disclosed therein are particularly preferred as the ascorbic acids or derivatives thereof for use in the developing solution of the present invention.

Endiol type, Enaminol type, Endiamin type, Thiol-Enol type and Enamin-Thiol type compounds are well known compounds as the ascorbic acids for use in the developing solution of the present invention. These compounds are disclosed in U.S. Pat. No. 2,688,549 and JP-A-62-237443. Synthesis methods of these ascorbic acids are also well known and disclosed, for example, in Tsugio Nomura, Hirohisa Ohmura, *Chemistry of Reductone*, Uchida-Rhokakuho Shinsha (1969).

The ascorbic acids for use in the present invention can also be used in the form of an alkali metal salt such as a lithium salt, a sodium salt, and a potassium salt. These ascorbic acids are used in an amount of from 1 to 100 g, preferably from 5 to 80 g, per liter of the developing solution.

In the present invention, it is particularly preferred to use ascorbic acids in combination with 1-phenyl-3-pyrazolidones or p-aminophenols.

Examples of the 3-pyrazolidone based developing agents for use in the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone.

The developing agent is used, in general, in an amount of preferably from 0.001 mol/liter to 1.2 mol/liter.

Examples of the p-aminophenol based developing agents for use in the present invention include N-methyl-p-aminophenol, p-aminophenol, N-(β-hydroxyethyl)-p-aminophenol, N-(4-hydroxyphenyl)glycine, 2-methyl-p-aminophenol, and p-benzylaminophenol, and N-methyl-p-aminophenol is preferred above all.

An alkali agent which is used for setting pH contains a pH adjusting agent such as sodium hydroxide, potassium hydroxide, sodium carbonate, potassium carbonate, sodium tertiary phosphate, and potassium tertiary phosphate.

As a sulfite preservative for use in the developing solution of the present invention, there are enumerated sodium sulfite, potassium sulfite, lithium sulfite, ammonium sulfite, sodium bisulfite, and potassium metabisulfite. The sulfite is preferably used in an amount of 0.01 mol/liter or more and particularly preferably 0.02 mol/liter or more, and the upper limit is preferably up to 2.5 mol/liter.

In addition to them, those disclosed in L. F. A. Mason, *Photographic Processing Chemistry*, Focal Press (1966), pages 226 to 229, U.S. Pat. Nos. 2,193,015, 2,592,364, and JP-A-48-64933 can also be used.

In general, boric acid compounds (for example, boric acid or borax) are often used as a pH buffer in a developing solution, but the developing solution containing ascorbic acids of the present invention preferably substantially does not contain boric acid compounds.

When the ascorbic acid-containing developing solution contains a boric acid compound, the effect of the present invention cannot be obtained even if the low oxygen-permeable package material of the present invention is used in combination.

The relationship between the existence and presence of the boric acid compound in the system of the present invention and the effect of the present invention was wholly unexpected.

The methods disclosed in JP-A-61-177132, JP-A-3-134666 and JP-A-3-67258 can be used for preparing the processing solutions of the present invention.

The replenishing methods disclosed in JP-A-5-216180 can be used for replenishing the developing solution in the processing method of the present invention.

When development processing is carried out by rapid processing of dry to dry of less than 60 seconds, it is preferred that the rubber rollers disclosed in JP-A-63-151943 are provided at the outlet of the developing tank to avoid the development unevenness peculiar to rapid processing, the discharge flow rate for stirring the developing solution in the developing tank is set at 10 m/min or more as disclosed in JP-A-63-151944, and that stirring at least during development processing is stronger than during waiting as disclosed in JP-A-63-264758.

The light-sensitive material of the present invention is not particularly limited as a photographic material. The photographic material of the present invention can be used as a photographic material for laser light source, a photographic material for printing, a photographic material for medical X-ray direct photographing, a photographic material for medical X-ray indirect photographing, a photographic material for CRT image recording, a microfilm, a color negative film for general photographing, a color reversal photographic material, and as a color photographic paper, but the photographic material of the present invention is particularly preferably used as a photographic material for medical X-ray direct photographing.

The present invention is described in detail below with reference to specific examples, but it should not be construed as being limited thereto.

EXAMPLE 1

Figure 3A:
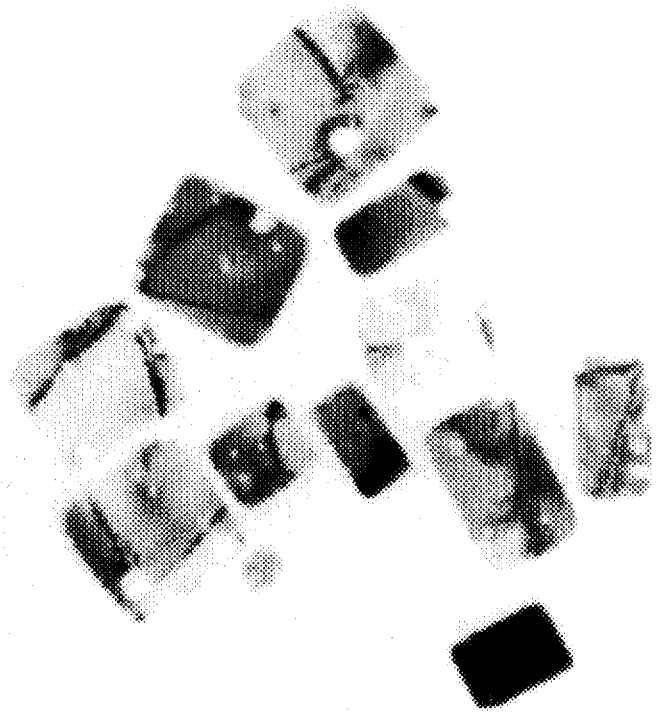
FIG. 3 (*a*) and (*b*) are a direct TEM image showing the crystal structure before grain growth of the silver halide grains of Emulsion A of the present invention in Example 1. The magnification is 30,000-fold.
Figure 3B:
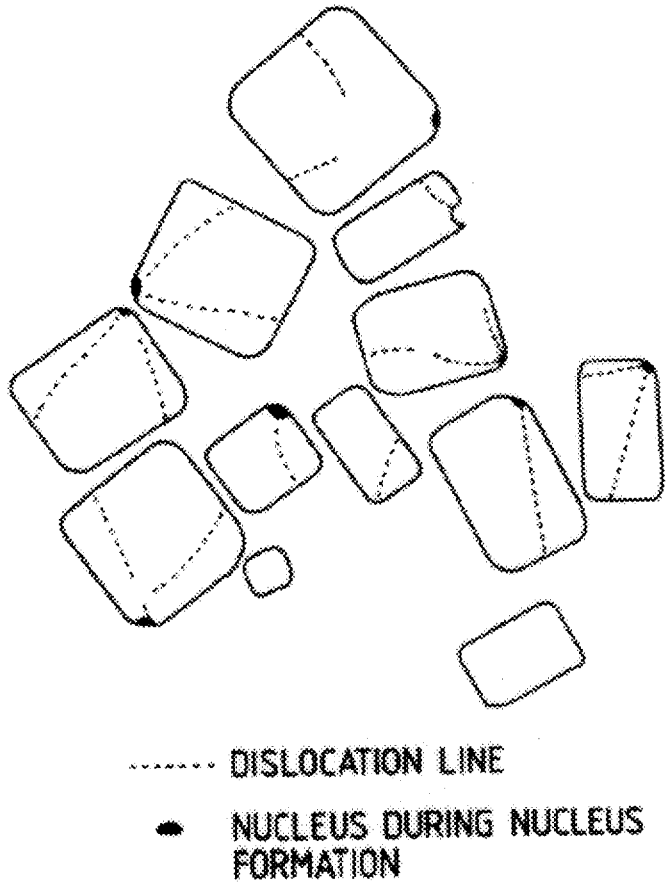

Preparation of Emulsion A of the Present Invention 1,582 ml of an aqueous solution of gelatin (containing 19.5 g of gelatin-1 (deionized alkali-processed bone gelatin of a methionine content of about 40 μmol/g) and 7.8 ml of $HNO_3$ 1 N solution, pH 4.3) and 13 ml of NaCl-1 solution (containing 10 g of NaCl in 100 ml of NaCl-1 solution) were put in a reaction vessel, while maintaining the temperature at 40° C., 15.6 ml of Ag-1 solution (containing 20 g of $AgNO_3$ in 100 ml of Ag-1 solution) and 15.6 ml of X-1 solution (containing 7.05 g of NaCl in 100 ml of X-1 solution) were simultaneously added to the vessel and mixed at a rate of 62.4 ml/min. After stirring for 3 minutes, 28.2 ml of Ag-2 solution (containing 2 g of $AgNO_3$ in 100 ml of Ag-2 solution) and 28.2 ml of X-2 solution (containing 1.4 g of KBr in 100 ml of X-2 solution) were simultaneously added thereto and mixed at a rate of 80.6 ml/min. After stirring for 3 minutes, 46.8 ml of Ag-1 solution and 46.8 ml of X-1 solution were simultaneously added and mixed at a rate of 62.4 ml/min. After stirring for 2 minutes, 203 ml of an aqueous solution of gelatin (containing 13 g of gelatin-1, 1.3 g of NaCl, and an NaOH 1 N solution to adjust pH to 6.5) was added to the reaction mixture, pCl was adjusted to 1.75, the temperature was raised to 75° C., pCl was set at 1.65, and ripening was carried out for 3 minutes. Subsequently, AgCl fine grain emulsion (E-1) (average grain size: 0.1 μm) was added to the mixture at AgCl addition rate of $2.68\times10^{-2}$ mol/min for 20 minutes. Ripening was carried out for 40 minutes after termination of the addition, then a precipitant was added, the temperature was reduced to 35° C., the precipitate was washed with water, an aqueous solution of gelatin was added, and pH was adjusted to 6.0 at 60° C. TEM image of the replica of the grains were observed. The emulsion obtained comprised silver chloride {100} tabular grains containing 0.44 mol % of AgBr based on the silver. The direct TEM image of the emulsion before addition of E-1 is shown in FIG. 3. The shape characteristic values of the grains were:

(entire projected area of {100} tabular grains having an aspect ratio of 2 or more/sum of projected area of all AgX-grains) × 100 = $a_1$ = 91

(average aspect ratio (average diameter/average thickness) of {100} tabular grains having an aspect ratio of 2 or more) = $a_2$ = 8.3

(average diameter of {100} tabular grains having an aspect ratio of 2 or more) = $a_3$ = 1.33 μm (adjacent major edge ratio of {100} tabular grains having an aspect ratio of 2 or more) = $a_4$ = 1.45

(average thickness of {100} tabular grains having an aspect ratio of 2 or more) = $a_5$ = 0.16 μm (variation coefficient of the distribution of the thickness of the grains (standard deviation of the thickness/average thickness) = $a_6$ = 0.13

Further, the grains of the present invention accounted for not less than 80% of the projected area of all the tabular grains. More details are as follows.

(total projected area of grains (i) having a {100} face as a major face, (ii) having an aspect ratio of 1.5 or more and (iii) having a nucleus during nucleus formation, the nucleus during nucleus formation being present in the square of not exceeding 10% of the entire projected area containing one corner when viewed the grains from the vertical direction to the major faces/sum of projected area of all AgX grains) × 100 = $a_7$ = 95

(total projected area of grains (i) having a {100} face as a major face, (ii) having an aspect ratio of 1.5 or more and (iii) having at least one dislocation line which can be observed when viewed the grains from the vertical direction to the major faces, the only one intersection of the dislocation line or the extension line of the dislocation line with the side face of {100} face of the tabular grain being present on not more than 15% of the side face containing one corner/sum of projected area of all AgX grains) × 100 = $a_8$ = 94

(total projected area of grains (i) having a {100} face as a major face, (ii) having an aspect ratio of 1.5 or more and (iii) having two dislocation lines which can be observed when viewed the grains from the vertical direction to the major faces, the only one intersection of the dislocation line or the extension line of the dislocation line with the side face of {100} face of the tabular grain being present on not more than 15% of the side face containing one corner/sum of projected area of all AgX grains) × 100 = $a_9$ = 92

(total projected area of grains (i) having a {100} face as a major face, (ii) having an aspect ratio of 1.5 or more and (iii) having at least one dislocation line which can be observed when viewed the grains from the vertical direction to the major faces, the only one intersection of the dislocation line or the extension line of the dislocation line with the side face of {100} face of the tabular grain being present on not more than 7% of the side face containing one corner/sum of projected area of all AgX grains) × 100 = $a_{10}$ = 90

(total projected area of grains (i) having a {100} face as a major face, (ii) having an aspect ratio of 1.5 or more and (iii) having two dislocation lines which can be observed when viewed the grains from the vertical direction to the major faces, the only one intersection of the dislocation line or the extension line of the dislocation line with the side face of {100} face of the tabular grain being present on not more than 7% of the side face containing one corner/sum of projected area of all AgX grains) × 100 = $a_{11}$ = 88

(total projected area of grains (i) having a {100} face as a major face, (ii) having an aspect ratio of 1.5 or more and (iii) having two dislocation lines which can be observed when viewed the grains from the vertical direction to the major faces, wherein the dislocation line or the extension line of the dislocation line extends from a nucleus, the nucleus being present in the square of not exceeding 10% of the entire projected area containing one corner/sum of projected area of all AgX grains) × 100 = $a_{12}$ = 80

When 10% of silver amount based on the silver amount of the complete silver halide grains is added;

(total projected area of grains (i) having a {100} face as a major face, (ii) having an aspect ratio of 1.5 or more and (iii) having two dislocation lines which can be observed when viewed the grains from the vertical direction to the major faces, wherein the dislocation line or the extension line of the dislocation line extends from a nucleus, the nucleus being present in the square of not exceeding 10% of the entire projected area containing one corner/sum of projected area of all AgX grains) × 100 = $a_{13}$ = 98

When 30% of silver amount based on the silver amount of the complete silver halide grains is added;

(total projected area of grains (i) having a {100} face as a major face, (ii) having an aspect ratio of 1.5 or more and (iii) having two dislocation lines which can be observed when viewed the grains from the vertical direction to the major faces, wherein the dislocation line or the extension line of the dislocation line extends from a nucleus, the nucleus being present in the square of not exceeding 10% of the entire projected area containing one corner/sum of projected area of all AgX grains) × 100 = $a_{14}$ = 87

When 85% of silver amount based on the silver amount of the complete silver halide grains is added;

(total projected area of grains (i) having a {100} face as a major face, (ii) having an aspect ratio of 1.5 or more and (iii) having two dislocation lines which can be observed when viewed the grains from the vertical direction to the major faces, wherein the dislocation line or the extension line of the dislocation line extends from a nucleus, the nucleus being present in the square of not exceeding 10% of the entire projected area containing one corner/sum of projected area of all AgX grains) × 100 = $a_{15}$ = 84

Preparation of Emulsion B of the Present Invention pCl of Emulsion A of the present invention was, after the temperature was raised to 75° C., adjusted to 2.0 and maintained constant thereafter and, in place of adding AgCl fine grain emulsion (E-1), Ag-3 solution (containing 50 g of $AgNO_3$ in 100 ml of Ag-3 solution) and X-3 solution (containing 17.6 g of NaCl in 100 ml of X-3 solution) were added by a controlled double jet method at a constant feed rate for 20 minutes until the addition amount of Ag-3 solution reached 182 ml. TEM image of the replica of the grains was observed. The emulsion obtained comprised silver chloride {100} tabular grains containing 0.44 mol % of AgBr based on the silver. The shape characteristic values of the grains were: $a_1$=91, $a_2$=8.2, $a_3$=1.32 μm, $a_4$=1.64, $a_5$=0.16 μm, $a_6$=0.15.

Further, the grains of the present invention accounted for not less than 79% of the projected area of all the tabular grains. More details are as follows.

$a_7$=93, $a_8$=91, $a_9$=90, $a_{10}$=87, $a_{11}$=86, $a_{12}$=79, $a_{13}$=97, $a_{14}$=84, $a_{15}$=82.

Figure 4A:
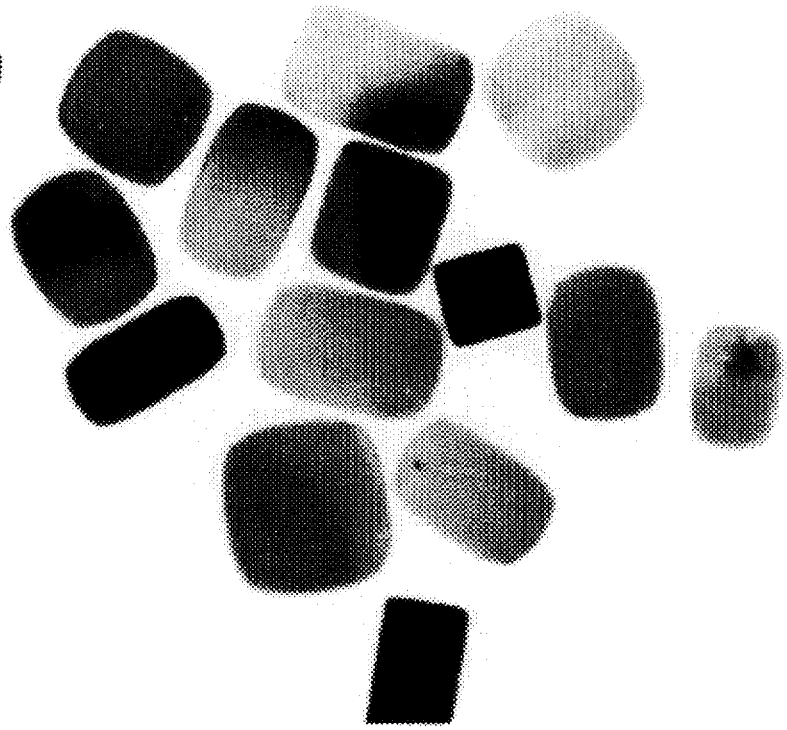
FIG. 4 (*a*) and (*b*) are a direct TEM image showing the crystal structure before grain growth of the silver halide grains of Comparative Emulsion C in Example 1. The magnification is 30,000-fold.
Figure 4B:
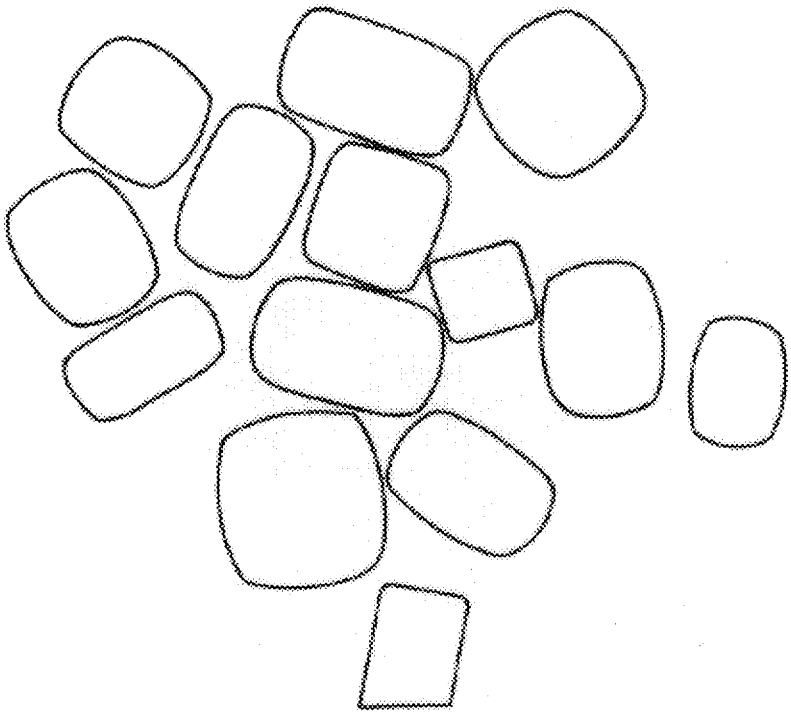

Preparation of Comparative Emulsion C 1,582 ml of an aqueous solution of gelatin (containing 19.5 g of gelatin-1 (deionized alkali-processed bone gelatin of a methionine content of about 40 μmol/g) and 7.8 ml of $HNO_3$1 N solution, pH-4.3) and 13 ml of NaCl-1 solution (containing 10 g of NaCl in 100 ml of NaCl-1 solution) were put in a reaction vessel, while maintaining the temperature at 40° C., 15.6 ml of Ag-1 solution (containing 20 g of $AgNO_3$ in 100 ml of Ag-1 solution) and 15.6 ml of X-1 solution (containing 7.05 g of NaCl in 100 ml of X-1 solution) were simultaneously added to the vessel and mixed at a rate of 62.4 ml/min. After stirring for 3 minutes, 28.2 ml of Ag-2 solution (containing 2 g of $AgNO_3$ in 100 ml of Ag-2 solution) and 28.2 ml of X-2 solution (containing 1.4 g of KBr in 100 ml of X-2 solution) were simultaneously added thereto and mixed at a rate of 80.6 ml/min. After stirring for 3 minutes, 46.8 ml of Ag-1 solution and 46.8 ml of X-1 solution were simultaneously added and mixed at a rate of 62.4 ml/min. After stirring for 2 minutes, 203 ml of an aqueous solution of gelatin (containing 13 g of gelatin-1, 1.3 g of NaCl, and NaOH 1 N solution to adjust pH to 5.0) was added to the reaction mixture, pCl was adjusted to 1.52, the temperature was raised to 75° C., pH was set at 6.5, pCl was set at 1.65, and ripening was carried out for 90 minutes. Subsequently, AgCl fine grain emulsion (E-1) (average grain size: 0.1 μm) was added to the mixture at AgCl addition rate of $2.68\times10^{-2}$ mol/min for 20 minutes. Ripening was carried out for 40 minutes after termination of the addition, then a precipitant was added, the temperature was reduced to 35° C., the precipitate was washed with water, an aqueous solution of gelatin was added, and pH was adjusted to 6.0 at 60° C. TEM image of the replica of the grains was observed. The emulsion obtained comprised silver chloride {100} tabular grains containing 0.44 mol % of AgBr based on the silver. The direct TEM image of the emulsion before addition of E-1 is shown in FIG. 4. The shape characteristic values of the grains were: $a_1$=91, $a_2$=5.4, $a_3$=1.28 μm, $a_4$=1.64, $a_5$=0.21 μm, $a_6$=0.40.

Further, the grains of the present invention accounted for less than 10% of the projected area of all the tabular grains in Emulsion C. More details are as follows.

$a_7$=5, $a_8$=4, $a_9$=4.2, $a_{10}$=3.6, $a_{11}$=3.4, $a_{12}$=2, $a_{13}$=9.3, $a_{14}$=8, $a_{15}$=3.

Preparation of Comparative Emulsion D pH and pCl of Comparative Emulsion C, after the temperature was raised to 75° C., were set at 6.5 and 1.65, respectively, and ripening was carried out for 90 minutes. Subsequently, pH was adjusted to 8.5, pCl was adjusted to 2.25, and E-1 was added to the mixture at AgCl addition rate of $1.34\times10^{-2}$ mol/min for 40 minutes. Ripening was carried out for 90 minutes after termination of the addition, then a precipitant was added, the temperature was reduced to 35° C., the precipitate was washed with water, an aqueous solution of gelatin was added, and pH was adjusted to 6.0 at 60° C. TEM image of the replica of the grains was observed. The emulsion obtained comprised silver chloride {100} tabular grains containing 0.44 mol % of AgBr based on the silver. The shape characteristic values of the grains were: $a_1$=91, $a_2$=8.0, $a_3$=1.28 μm, $a_4$=1.55, $a_5$=0.16 μm, $a_6$=0.35. Further, the grains of the present invention accounted for less than 10% of the projected area of all the tabular grains in Emulsion C. More details are as follows.

$a_7$=5.6, $a_8$=4.3, $a_9$=4.7, $a_{10}$=4, $a_{11}$=4, $a_{12}$=2.5, $a_{13}$=9.7, $a_{14}$=8, $a_{15}$=3.

Chemical Sensitization

Each of the above prepared emulsions was chemical sensitized with stirring while maintaining the temperature at 60° C. First of all, $10^{-4}$ mol/mol of silver halide of thiosulfonic acid compound-I was added, then $1\times10^{-6}$ mol/mol of Ag of thiourea dioxide was added, and allowed to stand for 22 minutes and reduction sensitization was carried out. Subsequently, 4-hydroxy-6-methyl-1,3,3a,7-tetraazaindene in an amount of $3\times10^{-4}$ mol/mol of Ag, and Sensitizing Dye-1 and Sensitizing Dye-2 were added respectively added. Further, calcium chloride was added, then $6\times10^{-6}$ mol/mol of Ag of sodium thiosulfate and $4\times10^{-6}$ mol/mol of Ag of selenium compound-I were added. Still further, $1\times10^{-5}$ mol/mol of Ag of chloroauric acid and $1\times10^{-3}$ mol/mol of Ag of potassium thiocyanate were added, and after 40 minutes the temperature was reduced to 35° C.

Thus, the adjustment (chemical ripening) of the emulsion was completed.

Thiosulfonic Acid Compound-I $C_2H_5SO_2SNa$

Sensitizing Dye-1

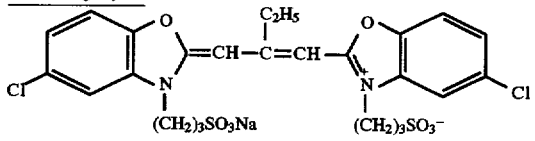

$1\times10^{-3}$ mol/mol Ag

Sensitizing Dye-2

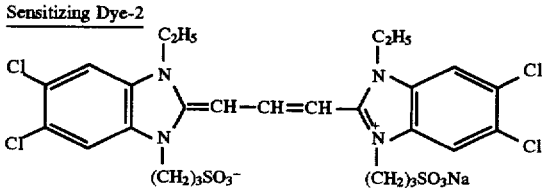

$1\times10^{-5}$ mol/mol Ag

Prepration of Emulsion Coated Layer

The following compounds per mol of the silver halide were added to the above chemical sensitized emulsion to prepare an emulsion coating solution.

| | |
|---|---|
| Gelatin (including the gelatin in the emulsion) | 111 g |
| Dextran (average molecular weight: 39,000) | 21.5 g |
| Sodium Polyacrylate (average molecular weight: 400,000) | 5.1 g |
| Sodium Polystyrenesulfonate (average molecular weight: 600,000) | 1.2 g |
| Hardening Agent, 1,2-Bis(vinylsulfonylacetamido)-ethane (addition amount was adjusted so that the swelling rate reached 230%) | 1.2 g |
| Compound-I | 42.1 mg |
| Compound-II | 10.3 g |
| Compound-III | 0.11 g |
| Compound-IV | 8.5 mg |
| Compound-V | 0.43 g |
| Compound-VII | 0.1 g |
| Compound-VIII | 0.1 g |
| pH was adjusted to 6.1 with NAOH | |

Compound-I

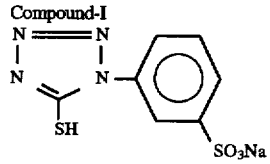

-continued

Compound-II

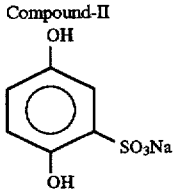

Compound-III

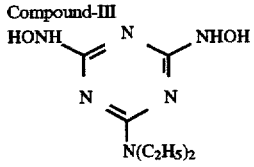

Compound-IV

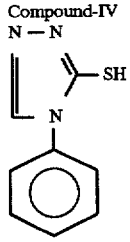

Compound-V

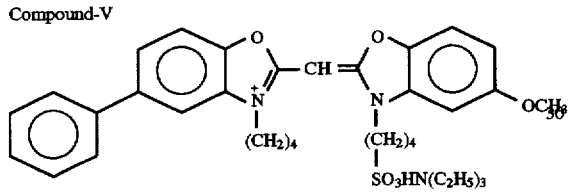

Compound-VII

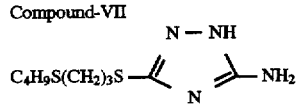

Compound-VIII

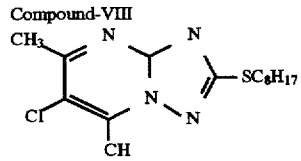

Dye Emulsion A was added to the above coating solution so that the coating weight of Dye-I per one side became 10 mg/m$^2$.

Dye-1

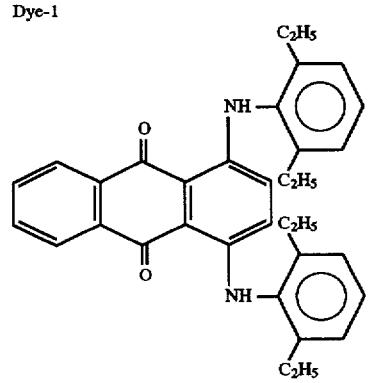

Preparation of Dye Emulsion A 60 g of the above Dye-I, 62.8 g of the following High Boiling Point Organic Solvent-I, 62.8 g of the following High Boiling Point Organic Solvent-II, and 333 g of ethyl acetate were dissolved at 60° C. Then, 65 cc of a 5% aqueous solution of sodium dodecylbenzenesulfonate, 94 g of gelatin and 581 cc of water were added to the solution, and dispersed in an emulsion condition using a dissolver over 30 minutes. Then, 2 g of the following Compound-X and 6 liters of water, were added and the temperature was reduced to 40° C. Subsequently, the emulsion was concentrated until the total weight reached 2 kg using ultrafiltration labo module ACP1050 manufactured by Asahi Chemical Industry Co., Ltd., and 1 g of the following Compound-X was added thereto to obtain Dye Emulsion A.

High Boiling Point Organic Solvent-I

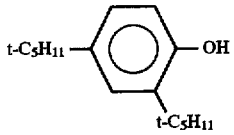

High Boiling Point Organic Solvent-II

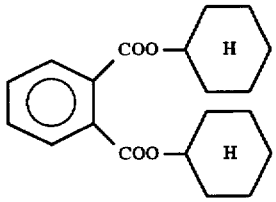

Compound-X

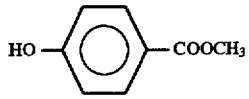

Preparation of Coating Solution for Surface Protective Layer

The surface protective layer was prepared so that the coating weight of each composition became as indicated below.

| | |
|---|---|
| Gelatin | 0.780 g/m$^2$ |
| Sodium Polyacrylate (average molecular weight: 400,000) | 0.035 g/m$^2$ |
| Sodium Polystyrenesulfonate (average molecular weight: 600,000) | 0.0012 g/m$^2$ |
| Polymethyl Methacrylate (average grain size: 3.7 μm) | 0.072 gm$^2$ |
| Coating Aid-I | 0.020 g/m$^2$ |
| Coating Aid-II | 0.037 g/m$^2$ |
| Coating Aid-III | 0.0080 g/m$^2$ |
| Coating Aid-IV | 0.0032 g/m$^2$ |
| Coating Aid-V | 0.0025 g/m$^2$ |
| Compound-XI | 0.0022 g/m$^2$ |
| Proxel (pH was adjusted to 6.8 with NaOH) | 0.0010 g/m$^2$ |

Coating Aid-I

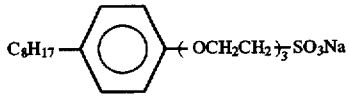

-continued

Coating Aid-II $C_{16}H_{33}O(CH_2CH_2O)_{10}H$

Coating Aid-III $C_8H_{17}-CH=CH(CH_2)_7CON(CH_3)-CH_2CH_2SO_3Na$

Coating Aid-IV $C_8F_{17}SO_2N(C_3H_7)(CH_2CH_2O)_{15}H$

Coating Aid-V $C_8F_{17}SO_2N(C_3H_7)(CH_2CH_2O)_4(CH_2)_4SO_3Na$

Compound-XI

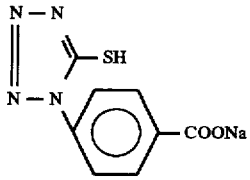

Preparation of Support

(1) Preparation of Dye Dispersion B for Undercoat Layer

The following Dye-II was treated by a ball mill according to JP-A-63-197943.

Dye-II

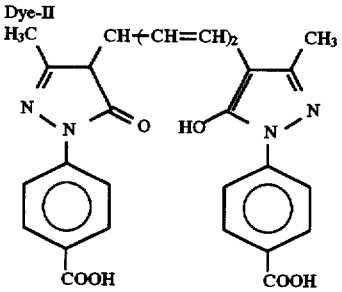

434 cc of water and 791 cc of a 6.7% aqueous solution of Triton X-200 (registered trademark) surfactant (TX-200 (registered trademark)) were put in a ball mill having a capacity of 2 liters. 20 g of the dye was added to the solution. 400 ml of beads of zirconium oxide ($ZrO_2$) (diameter: 2 mm) was added thereto and the content was pulverized over 4 days. Then, 160 g of 12.5% gelatin was added. After defoaming, $ZrO_2$ beads were removed by filtration. As a result of observing the obtained dye dispersion, it was confirmed that the grain sizes of the pulverized dye accounted for a wide range of from 0.05 to 1.15 μm and the average grain size was 0.37 μm.

The dye grains of the grain size of 0.9 μm or more were removed by centrifugal operation.

Thus, Dye Dispersion B was obtained.

(2) Preparation of Support

A biaxially stretched polyethylene terephthalate film having a thickness of 175 μm was corona discharged, and the first undercoat solution having the following composition was coated by a wire bar coater so that the coating amount reached 4.9 cc/m$^2$, and then dried at 185° C. for 1 minute.

Then, the first undercoat layer was also coated on the opposite side similarly. The polyethylene terephthalate used contained 0.04 wt % of Dye-I.

| | |
|---|---|
| Solution of Butadiene-Styrene Copolymer Latex (solid part: 40%, weight ratio of butadiene/styrene = 31/69) | 158 cc |
| A 4% Solution of Sodium 2,4-Dichloro-6-hydroxy-s-triazine | 41 cc |
| Distilled Water | 801 cc |

*In a latex solution, 0.4 wt %, based on the solid part of the latex, of the following compound was contained as an emulsifying dispersant.

Emulsifying Dispersant $nC_6H_{13}OOCCH_2$ $nC_6H_{13}OOCCH-SO_3Na$ (0.4 wt % based on the solid part of the latex)

(3) Coating of Undercoat Layer

On the first undercoat layers of both sides of the above support was coated the second undercoat layer having the following composition so as to reach the coating weight indicated below, one by one using a wire bar coater, and then dried at 155° C.

| | |
|---|---|
| Gelatin | 80 mg/m$^2$ |
| Dye Dispersion B (as dye solid part) | 8 mg/m$^2$ |
| Coating Aid-VI | 1.8 mg/m$^2$ |
| Compound-XII | 0.27 mg/m$^2$ |
| Matting Agent (polymethyl methacrylate having an average particle size of 2.5 μm) | 2.5 mg/m$^2$ |

Coating Aid-VI $C_{12}H_{25}O(CH_2CH_2O)_{10}H$

Compound-XII 0.27 mg/m$^2$

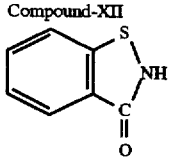

Preparation of Photographic Material

On both sides of the above prepared support, the aforementioned emulsion layer and the surface protective layer were coated in combination by a double extrusion method. The coating weight of silver per one side was 1.75 g/m$^2$.

Evaluation of Photographic Performance

Both sides of the photographic material were closely contacted with Ultravision First Detail (a product of Du Pont Co., Ltd.) and exposed for 0.05 sec from both sides and X-ray sensitometry was carried out. The adjustment of the exposure amount was conducted by changing the distance between X-ray tube and the cassette. After exposure, the photographic material was processed using the following automatic processor and processing solutions, and the evaluation of sensitivity was carried out. The sensitivity was expressed by the logarithmic value of the reciprocal of the exposure amount required to give a density of fog +1.0. The sensitivity of Emulsion A was taken as 100 and others were expressed by the relative values.

Processing

Automatic Processor: CEPROS-M, a product of Fuji Photo Film Co., Ltd., was modified and a heating roller was installed in the drying zone to increase the transfer rate to get dry to dry time of 30 sec.

Preparation of Concentrated Solution

Developing Solution

| | |
|---|---|
| **Part A Solution** | |
| Potassium Hydroxide | 330 g |
| Potassium Sulfite | 630 g |
| Sodium Sulfite | 255 g |
| Potassium Carbonate | 90 g |
| Boric Acid | 45 g |
| Diethylene Glycol | 180 g |
| Diethylenetriaminepentaacetic Acid | 30 g |
| 1-(N,N-Diethylamino)ethyl-5-mercaptotetrazole | 0.75 g |
| Hydroquinone | 450 g |
| 4-Hydroxymethyl-4-methyl-l-phenyl-3-pyrazolidone | 60 g |
| Water to make | 4,125 ml |
| **Part B Solution** | |
| Diethylene Glycol | 525 g |
| 3,3'-Dithiobishydrocinnamic Acid | 3 g |
| Glacial Acetic Acid | 102.6 g |
| 2-Nitroindazole | 3.75 g |
| 1-Phenyl-3-pyrazolidone | 34.5 g |
| Water to make | 750 ml |
| **Part C Solution** | |
| Glutaraldehyde (50 wt/wt %) | 150 g |
| Potassium Bromide | 15 g |
| Potassium Metabisulfite | 105 g |
| Water to make | 750 ml |
| **Fixing Solution** | |
| Ammonium Thiosulfate (70 wt/vol %) | 3,000 ml |
| Disodium Ethylenediaminetetraacetate Dihydrate | 0.45 g |
| Sodium Sulfite | 225 g |
| Boric Acid | 60 g |
| 1-(N,N-Dimethylamino)ethyl-5-mercaptotetrazole | 15 g |
| Tartaric Acid | 48 g |
| Glacial Acetic Acid | 675 g |
| Sodium Hydroxide | 225 g |
| Sulfuric Acid (36 N) | 58.5 g |
| Aluminum Sulfate | 150 g |
| Water to make | 6,000 ml |
| pH | 4.68 |

Preparation of Processing Solution

The above concentrated developing solution was filled in the following container with each part solution separate. This container consists of three part containers for Part Solutions A, B and C connecting by the container itself.

The above concentrated fixing solution was also filled in the same kind of container.

At first, 300 ml of an aqueous solution containing 54 g of acetic acid and 55.5 g of potassium bromide was added to the developing tank as a starter.

The above containers containing the processing solutions were made upside down and inserted to the drilling blades of the stock tanks of processing solutions equipped at the side of the processor to break the sealing films of the caps and each processing solution in the container was filled in the stock tank.

Each processing solution was added to the developing tank and the fixing tank in the proportion described below respectively by actuating the pump equipped in the processor.

Further, the concentrated solutions and water were mixed and replenished to the processing tanks of the processor in the same proportion as the above with every processing of eight sheets of the materials calculated in terms of a quarter size.

| | |
|---|---|
| **Developing Solution** | |
| Part A Solution | 51 ml |
| Part B Solution | 10 ml |
| Part C Solution | 10 ml |
| Water | 125 ml |
| pH | 10.50 |
| **Fixing Solution** | |
| Concentrated Solution | 80 ml |
| Water | 120 ml |
| pH | 4.62 |

The washing tank was filled with a tap water.

Three polyethylene bottles filled with 0.4 g of perlite having average diameter of 100 μm and average pore diameter of 3 μm and carrying actinomyces as a scale inhibitor were prepared (the opening part of the bottle was covered with a nylon cloth of 300 mesh, and water and actinomyces could pass through the cloth). The bottles were sunk in the bottom, two in the washing tank and one in the stock tank (amount of water: 0.2 liters) of the washing tank.

| Processing Speed and Processing Temperature | | |
|---|---|---|
| Development | 35° C. | 8.8 sec |
| Fixing | 32° C. | 7.7 sec |
| Washing | 17° C. | 3.8 sec |
| Squeegeeing | | 4.4 sec |
| Drying | 58° C. | 5.3 sec |
| Total | | 30 sec |

| Replenishment Rate | |
|---|---|
| Developing Solution | 25 ml/10 × 12 inches |
| Fixing Solution | 25 ml/10 × 12 inches |

Figure 5A:
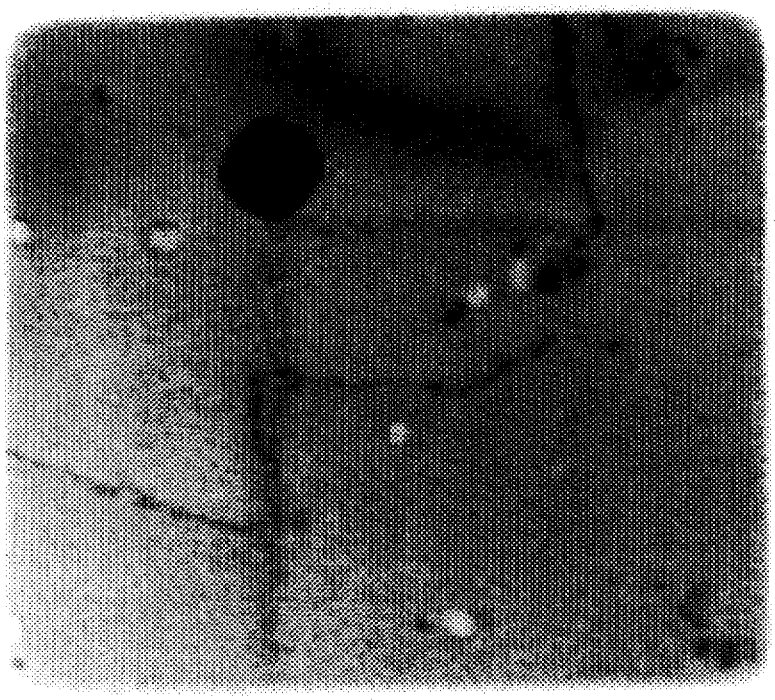
FIG. 5 (*a*) and (*b*) are a direct TEM image showing the crystal structure after grain growth of the silver halide grains of Emulsion A of the present invention to which KI was added to confirm the direction of the anisotropic growth when 50% of the total addition amount of silver was added. The magnification is 90,000-fold.
Figure 5B:
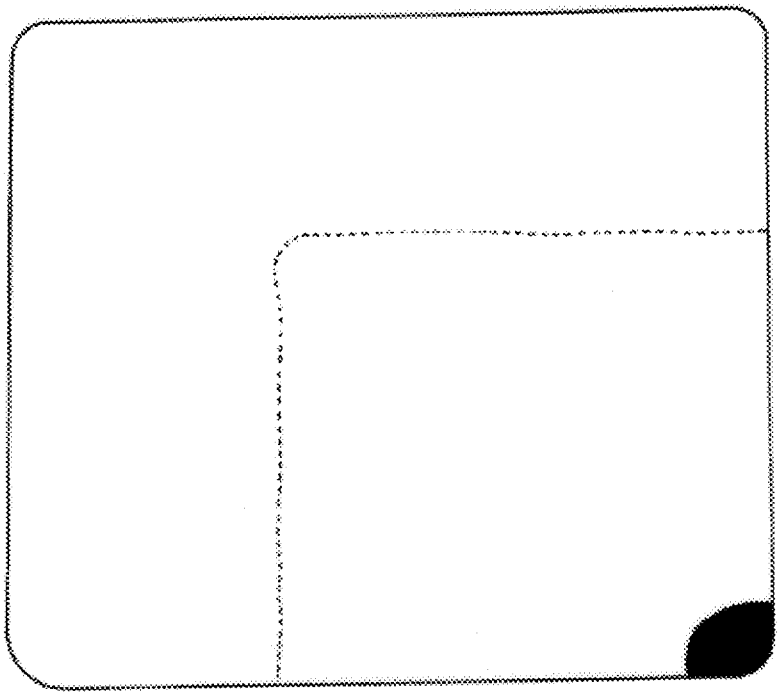
Figure 6A:
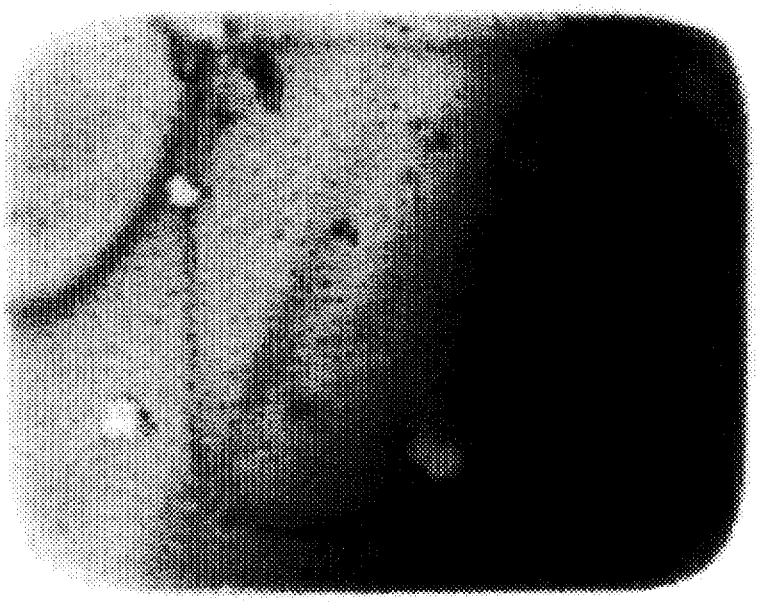
FIG. 6 (*a*) and (*b*) are a direct TEM image showing the crystal structure after grain growth of the silver halide grains of Comparative Emulsion C to which KI was added to confirm the direction of the anisotropic growth when 50% of the total addition amount of silver was added. The magnification is 90,000-fold.
Figure 6B:
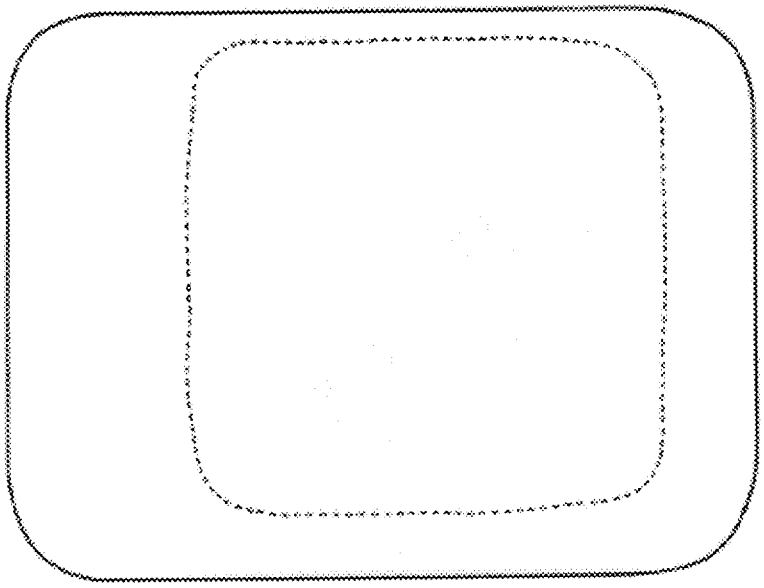

Confirmation of Direction of Anisotropic Growth and Indirect Confirmation of the Position of Nucleus During the addition of fine grain emulsion (E-1) to Emulsion A of the present invention and Comparative Emulsions C and D, and during the addition of Ag-3 and X-3 to Emulsion B of the present invention, 0.6 mol % of KI based on the addition amount of the silver was added to each emulsion and ripening was conducted for 20 minutes, then the remaining E-1, and Ag-3 and X-3 were respectively added. The addition timing was tried variously. The confirmation of the direction of the anisotropic growth of the grain and indirect confirmation of the position of the nucleus was conducted by direct TEM image of the grains after growth. Direct TEM images after grain growth of Emulsion A of the present invention and Comparative Emulsion C to which KI was added to confirm the direction of the anisotropic growth when 50% of the total addition amount of silver was added are respectively shown in FIG. 5 and FIG. 6.

The photographic material of the present invention thus-obtained was exposed to X-ray and image was formed using the fluorescent screen disclosed in JP-A-6-11804. It was confirmed that excellent X-ray image could be obtained. When comparing the shape characteristic values of the grains of Emulsion A of the present invention and those of Comparative Emulsion C, the anisotropic growing property of Emulsion A of the present invention was remarkably superior. Further, the variation coefficient of the distribution of thickness of Emulsion A of the present invention was extremely small compared with that of Comparative Emulsion C. This fact corresponds to the result that, from the direct TEM images of before grain growth, many of the grains of Emulsion A were confirmed having two dislocation lines important to the growth under low supersaturation and nucleus, on the contrary, dislocation lines had been dissolved and nuclei could not be confirmed in many of the grains of Comparative Emulsion C.

Further, when comparing the direct TEM images of the grains introduced the growth history into the grain by the addition of KI (FIGS. 5 and 6), in Emulsions A and B of the present invention, the nucleus was present at one corner and extended to two directions from the corner (FIG. 1) and scarcely extended to the thickness direction, on the contrary, in Comparative Emulsions C and D, nuclei were present at the center of the grains and, although grains grew anisotropically (FIG. 2), they also grew to the thickness direction. It can be seen from this fact that the emulsion of the present invention is superior because the grain formation progresses under the conditions of not causing dissolution of the grains themselves in ripening.

The sensitivities of Emulsions A and B of the present invention and Comparative Emulsions C and D are shown in Table 1 below. (The sensitivity of Emulsion D is taken as 100).

TABLE 1

| Emulsion | Sensitivity | Fog |
|---|---|---|
| A | 140 | 0.04 |
| B | 138 | 0.04 |

TABLE 1-continued

| Emulsion | Sensitivity | Fog |
|---|---|---|
| C | 75 | 0.06 |
| D | 100 | 0.29 |

As is apparent from Table 1, the photographic material of the present invention is high sensitivity and low fog in rapid processing. Further, Emulsion D, which was grown under high pH and high pCl, was low sensitivity and high fog, although the shape characteristic values are close to those of the present invention.

EXAMPLE 2

Emulsions A to H were chemical sensitized in the same manner as in Example 1 except for using Tellurium Compound-I in place of Selenium Compound-I.

In rapid processing using tellurium compound, Emulsions A and B of the present invention showed high sensitivity and low fog similarly in the case of using selenium compound. In addition, the emulsions of the present invention showed excellent performance in pressurability almost the same as pure silver chloride.

EXAMPLE 3

Preparation of {111} Tabular Grain Emulsion E

Silver chloride tabular grains were prepared as follows.

| | |
|---|---|
| Solution (1) | |
| Inactive Gelatin | 30 g |
| Crystal Habit Inhibitor A | 0.8 g |
| 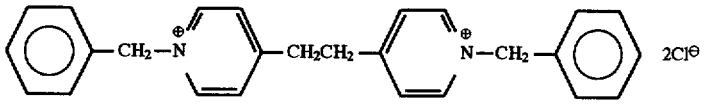 | |
| NaCl | 4 g |
| $H_2O$ | 1,750 cc |
| Solution (2) | |
| $AgNO_3$ | 7.6 g |
| $H_2O$ to make | 30 cc |
| Solution (3) | |
| NaCl | 2.8 g |
| $H_2O$ to make | 30 cc |
| Solution (4) | |
| $AgNO_3$ | 24.5 g |
| $H_2O$ to make | 96 cc |
| Solution (5) | |
| NaCl | 0.3 g |
| $H_2O$ to make | 65 cc |
| Solution (6) | |
| $AgNO_3$ | 101.9 g |
| $H_2O$ to make | 400 cc |
| Solution (7) | |
| NaCl | 37.6 g |
| $H_2O$ to make | 400 cc |

Solution (2) and Solution (3) were simultaneously added to Solution (1) maintained at 35° C. with stirring over 1 minute, the temperature of the solution was raised to 50° C. over 15 minutes. Grains corresponding to 5.7% of the total silver amount were formed at this point. Then, Solution (4) and Solution (5) were simultaneously added over 24 minutes; further, Solution (6) and Solution (7) were simultaneously added over 40 minutes, and silver chloride grains were obtained.

After the emulsion obtained were washed by precipitation method and desalted, 30 g of gelatin and $H_2O$ were added, further 2.0 g of phenoxyethanol and 0.8 g of sodium polystyrenesulfonate as a thickener were added, and again dispersed using sodium hydroxide to adjust pH to 6.0

The shape characteristic values of the obtained emulsion were: $a_1$=90, $a_3$=1.55 μm, $a_5$=0.18 μm, $a_2$=8.6, and were silver chloride tabular grain emulsion having {111} face as a main plane and variation coefficient of circle corresponding projected area diameter of 19%.

Chemical sensitization was carried out in the same manner as in Example 1.

Coated samples were prepared in the same manner as in Example 1 except for changing the following points.

In the preparation of the coating solution for the surface protective layer in Example 1, the coating solution prepared by excluding coating aid-II was designated y and the coating solution of Example 1 was designated x. Further, in the coating of the undercoat layer in Example 1, the coating solution for electrical conductive layer having the following composition was coated on the second undercoat layer so as to reach the coating weight indicated below, on both sides one by one using a wire bar coater, and dried to obtain support Y.

| | |
|---|---|
| Gelatin | 19 mg/m$^2$ |
| $SnO_2$/Sb (9/1 by weight ratio, average grain size: 0.24 μm) | 160 mg/m$^2$ |

This support in Example 1 not having an undercoat layer was designated support X.

Preparation of Photographic Material

On both sides of the above prepared support, the emulsion layer of Example 1, the aforementioned surface protective layer and the support were coated in combination by a double extrusion method as shown in Table 2. The coating weight of silver per one side was 1.75 g/m$^2$.

Evaluation of Photographic Performance

Both sides of the photographic material were closely contacted with HR-4 Screen of Fuji Photo Film. Co., Ltd. and exposed for 0.05 sec from both sides and X-ray sensitometry was carried out. The adjustment of the exposure amount was conducted by changing the distance between X-ray tube and the cassette. After exposure, the photographic material was processed using automatic processor CEPROS-30, developing solution CE-D30, and fixing solution CE-F30 (products of Fuji Photo Film Co., Ltd.), and the evaluation of sensitivity was carried out. The sensitivity was expressed by the reciprocal of the ratio of the exposure amount required to give a density of fog +1.0. The sensitivity of Sample 1 was taken as standard.

Evaluation of Low Replenishing Property

Photographic materials were processed using automatic processor CEPROS-30, developing solution CE-D30, and fixing solution CE-F30 (products of Fuji Photo Film Co., Ltd.) from fresh solutions, in the replenishing condition of 5 cc per a quarter size sheet. 1,000 sheets of photographic materials were exposed so that developing rate became 40%, then TP processed, and the evaluation of photographic performance was conducted. The sensitivity of Sample 1 in the above evaluation of photographic performance was taken as standard and expressed by the reciprocal of the ratio of the exposure amount required to give a density of fog +1.0. Development unevenness was visually evaluated according to the following standard. In addition, after the above processing, developing rack was taken off and the area ratio of the part where there were no foams was determined from the photograph on the developing solution surface and evaluated as foaming. Further, the developing solution was filtrated and the amount of precipitate was measured.

◎: Almost no generation of development unevenness

○: Development unevenness was generated a little but negligible

Δ: Development unevenness was generated but practicable x: Development unevenness was generated extremely and large density unevenness was also generated and impracticable

Evaluation of Electric Conductivity (ER) of Photographic Material

Photographic material was cut to 1 cm wide, 5 cm long and silver paste was coated in the lengthwise direction, and after humidity conditioning was conducted at 25° C., 10% RH for 2 hours, the electric conductivity in the width direction was measured and obtained in Ω/cm unit.

The results obtained are shogun in Table 2. It can be seen from the results in Table 2 that electrostatic characteristics and development unevenness in low replenishment processing are excellent within the scope of the present invention.

TABLE 2

| Photographic Material | Emulsion | Protective Layer | Support | Sensitivity | LogER | Low Replenishing Property: Photographic Material: Sensitivity | Low Replenishing Property: Photographic Material: Unevenness | Low Replenishing Property: Developing Solution: Foaming (%) | Low Replenishing Property: Developing Solution: Precipitation (g) | Remarks |
|---|---|---|---|---|---|---|---|---|---|---|
| 1 | D | x | X | 100 | 11.3 | 50 | x | 90 | 15 | Comparison |
| 2 | D | y | Y | 95 | 9.5 | 55 | ○ | 90 | 2 | Comparison |
| 3 | B | x | X | 138 | 11.3 | 135 | x | 95 | 5 | Comparison |
| 4 | B | y | X | 136 | 16 or more | 131 | Δ | 90 | 3 | Comparison |
| 5 | B | y | Y | 135 | 9.5 | 134 | ⊙ | 5 | 0 | Invention |
| 6 | A | x | X | 140 | 11.3 | 138 | x | 95 | 5 | Comparison |
| 7 | A | y | Y | 140 | 9.5 | 138 | ⊙ | 0 | 0 | Invention |
| 8 | E | x | X | 110 | 11.3 | 100 | x | 95 | 5 | Comparison |
| 9 | E | y | X | 105 | 16 or | 100 | x | 90 | 3 | Comparison |
| 10 | E | y | Y | 105 | 9.5 | 95 | Δ | 5 | 0 | Comparison |

EXAMPLE 4

Preparation of Emulsion F 7 g of potassium bromide and 8 g of low molecular weight gelatin having an average molecular weight of 15,000 were added to 1 liter of water, and 36 cc of an aqueous solution of silver nitrate (silver nitrate: 4.00 g) and 38 cc of an aqueous solution containing 5.9 g of potassium bromide were added by a double jet method, with stirring, to the vessel maintained at 55° C. over 37 seconds. Subsequently, an aqueous solution containing 18.6 g of gelatin was added thereto, then 89 cc of an aqueous solution of silver nitrate (silver nitrate: 9.8 g) was added over 22 minutes with increasing the temperature to 68° C. 7 cc of a 25% aqueous solution of ammonia was added to the mixture, and physical ripening was carried out for 10 minutes while maintaining the temperature at 68° C., then 6.5 cc of a 100% nitric acid solution was added. Subsequently, an aqueous solution containing 153 g of silver nitrate and an aqueous solution of potassium bromide were added by a controlled double jet method over 35 minutes while maintaining pAg at 8.5. The feed rate at this time was accelerated so that the feed rate at the time of termination of the addition reached 14 times that of the starting time of the addition. After the addition was completed, 35 cc of a solution of 2 N potassium thiocyanate was added. After physical ripening was carried out over 5 minutes at that temperature, the temperature was lowered to 35° C. The thus obtained grains were monodisperse pure silver bromide tabular grains having an average projected area diameter of 1.10 μm, thickness of 0.170 μm, and a variation coefficient of a diameter of 18.5%.

After the emulsion was desalted by coagulation, 62 g of gelatin and 1.75 g of phenoxyethanol were added to the emulsion and pH and pAg were adjusted to 6.5 and 8.5, respectively. sedimentation. The temperature was again raised to 40° C., and 35 g of gelatin, 2.35 g of phenoxyethanol and 0.8 g of sodium polystyrenesulfonate as a thickener were added, and pH and pAg were adjusted to 5.90 and 8.00, respectively, with sodium hydroxide and an aqueous solution of silver nitrate.

Chemical sensitization was conducted in the same manner as in Example 1. The preparation of coated samples were carried out in the same manner as in Example 1 except for changing the following points.

Two samples of emulsion coating solutions were prepared such that in one sample Dye Emulsion A was added to emulsion coating solution of Example 1 so that the coating weight of each of Ultraviolet Absorbing Dye-I to -III per one side became 10 mg/m$^2$ and in other sample Dye Emulsion A was not added.

Dye-I

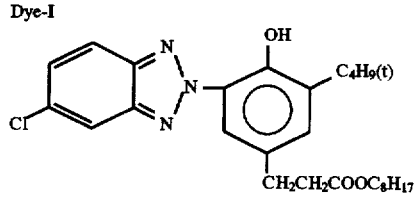

Dye-II

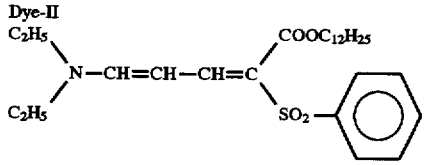

Dye-III

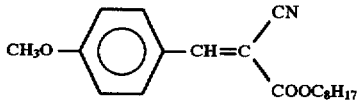

Preparation of Dye Emulsion A 20 g of each of the above Dye-I to -III, 62.8 g of the following High Boiling Point Organic Solvent-I, 62.8 g of the following High Boiling Point Organic Solvent-II, and 333 g of ethyl acetate were dissolved at 60° C. Then, 65 cc of a 5% aqueous solution of sodium dodecylbenzenesulfonate, 94 g of gelatin and 581 cc of water were added to the solution, and dispersed in an emulsion condition using a dissolver over 30 minutes. Then, 2 g of the following Compound-VI and 6 liters of water were added thereto and the temperature was reduced to 40° C. Subsequently, the emulsion was concentrated until the total weight reached 2 kg using ultrafiltration labo module ACP1050 manufactured by Asahi Chemical Industry Co., Ltd., and 1 g of the above Compound-VI was added thereto to obtain Dye Emulsion A.

High Boiling Point Organic Solvent-I

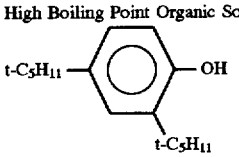

High Boiling Point Organic Solvent-II

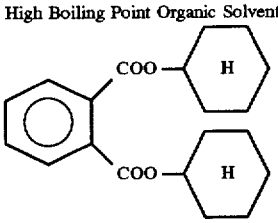

Compound-VI

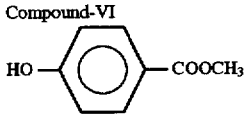

Preparation of Support A

A biaxially stretched polyethylene terephthalate film having a thickness of 175 μm was corona discharged, and the first undercoat solution having the following composition was coated by a wire bar coater so that the coating amount reached 4.9 cc/m$^2$, and then dried at 185° C. for 1 minute.

Then, the first undercoat layer was also coated on the opposite side similarly. The polyethylene terephthalate used contained 0.06 wt % of Dye-IV and 0.06 wt % of Dye-V.

Dye-IV

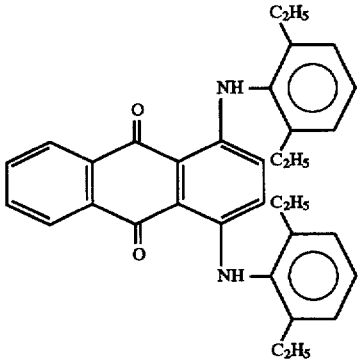

Dye-V

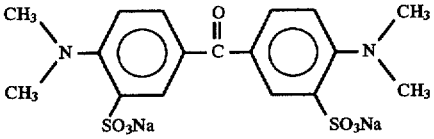

| | |
|---|---|
| Solution of Butadiene-Styrene Copolymer Latex (solid part: 40%, weight ratio of butadiene/styrene = 31/69) | 158 cc |
| A 4% Solution of Sodium 2,4-Dichloro-6-hydroxy-s-triazine | 41 cc |
| Distilled Water | 801 cc |

*In a latex solution, 0.4 wt %, based on the solid part of the latex, of the following compound was contained as an emulsifying dispersant.

-continued

Emulsifying Dispersant

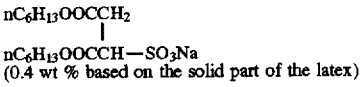

(0.4 wt % based on the solid part of the latex)

Preparation of Support B

Support B was prepared in the same manner as the preparation of Support A except for excluding Dye-V. This support was the same support as in Example 1.

Preparation of Photographic Material

On both sides of the above prepared supports, the aforementioned emulsion layer and the surface protective layer were coated in combination by a double extrusion method. The coating weight of silver per one side was 1.40 g/m$^2$. Samples indicated in Table 3 were prepared in this way.

EXAMPLE 3

| Sample No. | Em | Dye Emulsion A | Support | Remarks |
|---|---|---|---|---|
| 8 | A | present | A | Invention |
| 9 | A | present | B | Invention |
| 10 | A | None | A | Invention |
| 11 | A | None | B | Comparison |
| 12 | B | present | A | Invention |
| 13 | B | present | B | Invention |
| 14 | B | None | A | Invention |
| 15 | B | None | B | Comparison |
| 16 | C | present | A | Comparison |
| 17 | C | present | B | Comparison |
| 18 | C | None | A | Comparison |
| 19 | C | None | B | Comparison |
| 20 | D | present | A | Comparison |
| 21 | D | present | B | Comparison |
| 22 | D | None | A | Comparison |
| 23 | D | None | B | Comparison |
| 24 | E | present | A | Comparison |
| 25 | E | present | B | Comparison |
| 26 | E | None | A | Comparison |
| 27 | E | None | B | Comparison |
| 28 | F | present | A | Comparison |
| 29 | F | present | B | Comparison |
| 30 | F | None | A | Comparison |
| 31 | F | None | B | Comparison |

Evaluation of Photographic Performance

Both sides of the photographic material were closely contacted with Ultravision First Detail (UV) of a product of Du Pont Co., Ltd. and exposed for 0.05 sec from both sides and X-ray sensitometry was carried out.

The adjustment of the exposure amount was made by changing the distance between X-ray tube and the cassette. After exposure, the photographic material was processed with the following developing solution and fixing solutions using an automatic processor.

Processing

Automatic Processor: CEPROS-M, a product of Fuji Photo Film Co., Ltd., was modified and a heating roller was installed in the drying zone to increase the transfer rate to get dry to dry time of 30 sec.

| Part A | |
|---|---|
| Potassium Hydroxide | 18.0 g |
| Potassium Sulfite | 30.0 g |
| Sodium Carbonate | 30.0 g |
| Diethylene Glycol | 10.0 g |
| Diethylenetriaminepentaacetic Acid | 2.0 g |
| 1-(N,N-Diethylamino)ethyl-5-mercaptotetrazole | 0.1 g |
| L-Ascorbic Acid | 43.2 g |
| 4-Hydroxymethyl-4-methyl-1-phenyl-3-pyrazolidone | 2.0 g |
| Water to make | 300 ml |
| Part B | |
| Triethylene Glycol | 45.0 g |
| 3,3'-Dithiobishydrocinnamic Acid | 0.2 g |
| Glacial Acetic Acid | 5.0 g |
| 5-Nitroindazole | 0.3 g |
| 1-Phenyl-3-pyrazolidone | 3.5 g |
| Water to make | 60 ml |
| Part C | |
| Glutaraldehyde (50%) | 10.0 g |
| Potassium Bromide | 4.0 g |
| Potassium Metabisulfite | 10.0 g |
| Water to make | 50 ml |

Water was added to 300 ml of Part A, 60 ml of Part B and 50 ml of Part C to make 1 liter and pH was adjusted to 10.90.

4.50 liters of Part A, 0.90 liters of Part B and 0.75 liters of Part C were filled in CE-DF1 bottle of Fuji Photo film Co., Ltd. for 1.5 liters of working solution.

Developing Starter

Acetic acid was added to the above developing replenisher and pH was adjusted to 10.20, this solution was used as a developing starter.

CE-F1 of Fuji Photo Film Co., Ltd. was used as a fixing solution.

Development temperature: 35° C.

Fixing temperature: 35° C.

Drying temperature: 55° C.

600 Sheets of each sample of film of 10×12 inch size were running processed with the replenishing rate (both developing solution and fixing solution) of 25 ml/10×21 inch size film (325 ml/m$^2$). The results obtained are shown in Table 3-2.

Measurement of Sharpness (MTF)

MTF of the processing of the combination of the above screen and automatic processor was measured. Measurement was carried out through the aperture of 30 μm×500 μm and evaluation was conducted using MTF values at the spatial frequency of 1.0 cycle/mm at the optical density of 1.0.

The results obtained are shown in Table 3-2. The photographic material of the present invention showed excellent sharpness and running processing performance.

TABLE 3-2

| Sample No. | MTF | Sensitivity at the Start of Running | Sensitivity at the End of Running |
|---|---|---|---|
| 8 | 0.93 | 130 | 125 |
| 9 | 0.85 | 140 | 135 |

TABLE 3-2-continued

| Sample No. | MTF | Sensitivity at the Start of Running | Sensitivity at the End of Running |
|---|---|---|---|
| 10 | 0.92 | 135 | 130 |
| 11 | 0.75 | 170 | 165 |
| 12 | 0.90 | 125 | 120 |
| 13 | 0.84 | 130 | 125 |
| 14 | 0.89 | 135 | 130 |
| 15 | 0.73 | 160 | 145 |
| 16 | 0.80 | 60 | 35 |
| 17 | 0.73 | 65 | 40 |
| 18 | 0.78 | 65 | 45 |
| 19 | 0.70 | 80 | 50 |
| 20 | 0.82 | 80 | 45 |
| 21 | 0.75 | 90 | 50 |
| 22 | 0.80 | 95 | 55 |
| 23 | 0.73 | 110 | 60 |
| 24 | 0.93 | 70 | 20 |
| 25 | 0.84 | 80 | 30 |
| 26 | 0.92 | 80 | 30 |
| 27 | 0.78 | 110 | 55 |
| 28 | 0.88 | 80 | 60 |
| 29 | 0.80 | 85 | 65 |
| 30 | 0.78 | 85 | 65 |
| 31 | 0.74 | 100 | 80 |

EXAMPLE 5

Preparation of {111} Tabular Grain Emulsion G (high sensitivity emulsion)

Emulsion G was prepared in the same manner as the preparation of Emulsion E except for changing the amounts of the inactive gelatin from 30 g to 20 g and Crystal Habit Inhibitor A from 0.8 g to 1.0 g.

The shape characteristic values of this emulsion were: $a_1$=95%, $a_2$=9.3, $a_3$=1.92 μ, $a_5$=0.206 μm, $a_6$=0.17.

Preparation of {100} Tabular Grain Emulsion H (high sensitivity emulsion)

Emulsion H was prepared in the same manner as the preparation of Emulsion B except for changing the temperature of nucleus formation from 40° C. to 50° C. and KBr amount in X-2 solution from 1.4 g to 1.0 g.

The shape characteristic values of this emulsion were: $a_1$=93%, $a_2$=8.0, $a_3$=1.93 μm, $a_5$=0.24 μm, $a_6$=0.22, $a_7$=93, $a_8$=94, $a_9$=93, $a_{10}$=90, $a_{11}$=90, $a_{12}$=81, $a_{13}$=98, $a_{14}$=88, $a_{15}$=84.

Preparation of Silver Halide Emulsion I (low sensitivity emulsion)

32 g of gelatin was dissolved in 1 liter of water in a vessel heated to 53° C., then 0.3 g of potassium bromide, 5 g of sodium chloride and 46 mg of Compound (I) shown below were added thereto, then 444 ml of an aqueous solution containing 80 g of silver nitrate and 452 ml of an aqueous solution containing 27.6 g of potassium bromide were added to the reaction solution by a double jet method over about 20 minutes. Subsequently, 400 ml of an aqueous solution containing 80 g of silver nitrate and 415 ml of an aqueous solution containing 28.5 g of potassium bromide and $10^{-7}$ mol/mol of silver of hexachloroiridium(III) acid potassium salt were added thereto by a double jet method over about 25 minutes, and cubic monodisperse silver chloride grains having an average grain size (projected area diameter) of 0.45 μm (variation coefficient of projected area diameter: 10%) were prepared.

Compound (I)

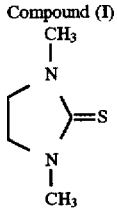

After the emulsion was desalted by coagulation, 62 g of gelatin and 1.75 g of phenoxyethanol were added thereto and pH and pAg were adjusted to 6.5 and 8.5, respectively.

Preparation of Silver Halide Emulsion J (high sensitivity emulsion)

Cubic monodisperse silver chloride grains having an average grain size of 0.65 μm (variation coefficient: 9%) were prepared in the same manner as the preparation of Emulsion I except for increasing the temperature from 53° C. to 60° C.

Chemical sensitization was carried out in the same manner as in Example 1 except that the amounts of the compounds added at the time of chemical sensitization were changed to the optimum amounts according to each emulsion.

Preparation of Photographic Material

On both sides of the support prepared in the same manner as in Example 1, coating solutions for emulsion layers prepared in the same manner as in Example 1 and the protective layer were coated in the same manner as in Example 1 as indicated in Table 4-1. The first emulsion layer is nearest to the support and the third emulsion layer is farthest from the support.

TABLE 4-1

| Sample No. | Emulsion of Third Layer (coated amount of silver*) (g/m²) | Emulsion of Second Layer (coated amount of silver*) (g/m²) | Emulsion of First Layer (coated amount of silver*) (g/m²) |
|---|---|---|---|
| 1 | E (1.7) | — | — |
| 2 | G (1.7) | — | — |
| 3 | B (1.7) | — | — |
| 4 | H (1.7) | — | — |
| 5 | I (1.7) | — | — |
| 6 | J (1.7) | — | — |
| 7 | H (0.85) | B (0.85) | — |
| 8 | B (0.57) | H (0.57) | E (0.56) |
| 9 | B (0.85) | H (0.85) | — |
| 10 | G (0.85) | E (0.85) | — |
| 11 | E (0.85) | H (0.85) | — |
| 12 | J (0.85) | I (0.85) | — |

TABLE 4-1-continued

| Sample No. | Emulsion of Third Layer (coated amount of silver*) (g/m²) | Emulsion of Second Layer (coated amount of silver*) (g/m²) | Emulsion of First Layer (coated amount of silver*) (g/m²) |
|---|---|---|---|
| 13 | I (0.85) | J (0.85) | — |
| 14 | I (0.57) | J (0.57) | E (0.56) |
| 15 | I (0.57) | J (0.57) | H (0.56) |
| 16 | B (0.57) | H (0.57) | I (0.56) |

*Coated silver amount per one side

Exposure and development processing were carried out in the same manner as in Example 1. The results obtained are shown in Table 4-2.

TABLE 4-2

| Sample No. | Sensitivity | G Value |
|---|---|---|
| 1 (Comparison) | 105 | 2.7 |
| 2 (Comparison) | 195 | 2.4 |
| 3 (Comparison) | 135 | 2.8 |
| 4 (Comparison) | 195 | 2.5 |
| 5 (Comparison) | 100 | 2.3 |
| 6 (Comparison) | 200 | 1.9 |
| 7 (Comparison) | 195 | 2.3 |
| 8 (Invention) | 170 | 3.0 |
| 9 (Invention) | 180 | 2.9 |
| 10 (Comparison) | 195 | 2.2 |
| 11 (Invention) | 170 | 3.0 |
| 12 (Comparison) | 200 | 2.3 |
| 13 (Comparison) | 160 | 2.5 |
| 14 (Comparison) | 165 | 2.4 |
| 15 (Invention) | 180 | 2.9 |
| 16 (Invention) | 170 | 3.1 |

The sensitivity is the reciprocal of the exposure amount required to give an optical density of fog +0.2 and is expressed by the relative value to the sensitivity of Sample 5 being taken as 100. Gradation G shows the gradient of the straight line joining the points of density 0.2 and 2.0 on the characteristic curve (density (2.0–0.2)/amount of exposure).

It can be seen from the results in Table 4-2 that the photographic materials of the present invention have high gradation (G value), high contrast and are excellent in sharpness.

Further, when the photographic materials were subjected to exposure through HGM Screen and HR-4 Screen of Fuji Photo film Co., Ltd., excellent photographic performances could be obtained similarly.

While the invention has been described in detail and with reference to specific examples thereof, it will be apparent to one skilled in the art that various changes and modifications can be made therein without departing from the spirit and scope thereof.

What is claimed is:

1. A silver halide emulsion which comprises at least one dispersion medium and a plurality of silver halide grains, wherein at least 30% of the total grain projected area of said silver halide grains is accounted for by tabular grains having (i) a {100} face as a major face, (ii) a diameter/thickness aspect ratio of at least 1.5, (iii) a nucleus formed during nucleus formation, said nucleus being present within a square of not more than 10% of the entire projected area of each of said silver halide grains upon viewing said silver halide grains from a direction perpendicular to the major faces, the square containing one corner of each of said silver halide grains, and (iv) a dislocation line, there occurring only one edge intersection of said dislocation line or an extension line of said dislocation line at or within 15% edge length from the nucleus-containing corner upon viewing the silver halide grains from a direction perpendicular to the major faces.

2. The silver halide emulsion as claimed in claim 1, wherein each tabular grain has two dislocation lines thereon.

3. The silver halide emulsion as claimed in claim 1, wherein the only one edge intersection of said dislocation line or the extension line of said dislocation line is at or within 7% edge length from the nucleus-containing corner upon viewing the silver halide grains from a direction perpendicular to the major faces.

4. The silver halide emulsion as claimed in claim 1, wherein at least 40% of the total grain projected area of said silver halide grains is accounted for by said tabular grains.

5. A silver halide emulsion as claimed in claim 1 which comprises at least one dispersion medium and a plurality of silver halide grains, wherein, after nucleus formation, and during physical ripening and/or during grain growth, and when 5 to 99% of silver amount is added based on the silver amount of the completed silver halide grains, at least one of a nucleus and a dislocation line are observed upon viewing said silver halide grains from a direction perpendicular to the major faces, said nucleus being present within a square of not more than 10% of the entire projected area of each of said silver halide grains, the square containing one corner of each of said silver halide grains, there occurring only one edge intersection of said dislocation line or an extension line of said dislocation line at or within 15% edge length from the nucleus-containing corner of each of said silver halide grains.

6. The silver halide emulsion as claimed in claim 1, which is gold and/or chalcogen sensitized.

7. A silver halide photographic material comprising a support having provided thereon at least one emulsion layer, wherein a dissolution resistant electrically conductive material is contained in the emulsion layer side of the support, and wherein said at least one emulsion layer containing a silver halide emulsion comprises at least one dispersion medium and a plurality of silver halide grains, wherein at least 30% of the total grain projected area of said silver halide grains is accounted for by tabular grains having (i) a {100} face as a major face, (ii) a diameter/thickness aspect ratio of at least 1.5, (iii) a nucleus formed during nucleus formation, said nucleus being present within a square of not more than 10% of the entire projected area of each of said silver halide grains upon viewing said silver halide grains from a direction perpendicular to the major faces, the square containing one corner of each of said silver halide grains, and (iv) a dislocation line, there occurring only one edge intersection of said dislocation line or an extension line of said dislocation line at or within 15% edge length from the nucleus-containing corner upon viewing the silver halide grains from a direction perpendicular to the major faces.

8. The silver halide photographic material claimed in claim 7, wherein said dissolution resistant electrically conductive material is a metal oxide.

9. A silver halide photographic material containing an ultraviolet absorbing agent, which comprises a support having provided thereon an emulsion layer containing a silver halide emulsion which comprises at least one dispersion medium and a plurality of silver halide grains, wherein at least 30% of the total grain projected area of said silver halide grains is accounted for by tabular grains having (i) a {100} face as a major face, (ii) a diameter/thickness aspect ratio of at least 1.5, (iii) a nucleus formed during nucleus formation, said nucleus being present within a square of not more than 10% of the entire projected area of each of said silver halide grains upon viewing said silver halide grains from a direction perpendicular to the major faces, the square containing one corner of each of said silver halide grains, and (iv) a dislocation line, there occurring only one edge intersection of said dislocation line or an extension line of said dislocation line at or within 15% edge length from the nucleus-containing corner upon viewing the silver halide grains from a direction perpendicular to the major faces.

10. A silver halide photographic material comprising a support having at least two silver halide emulsion layers provided on at least one side of a support, wherein a first emulsion layer and a second emulsion layer both selected from said at least two silver halide emulsion layers satisfy the following 1) and 2):

1) said first and second emulsion layers both contain a silver halide emulsion which comprises at least one dispersion medium and a plurality of silver halide grains, wherein at least 30% of the total grain projected area of said silver halide grains is accounted for by tabular grains having (i) a {100} face as a major face, (ii) a diameter/thickness aspect ratio of at least 1.5, (iii) a nucleus formed during nucleus formation, said nucleus being present within a square of not more than 10% of the entire projected area of each of said silver halide grains upon viewing said silver halide grains from a direction perpendicular to the major faces, the square containing one corner of each of said silver halide grains, and (iv) a dislocation line, there occurring only one edge intersection of said dislocation line or an extension line of said dislocation line at or within 15% edge length from the nucleus-containing corner upon viewing the silver halide grains from a direction perpendicular to the major faces; and 2) said second emulsion layer is farther from the support than said first emulsion layer, and said second emulsion layer has a higher sensitivity than said first emulsion layer.

11. A silver halide radiographic material used in combination with a fluorescent intensifying screen which emits a light having a peak at a wavelength of 400 nm or less by X-ray exposure, which comprises a support having provided thereon at least one emulsion layer, wherein a dissolution resistant electrically conductive material is contained in the emulsion layer side of the support, and wherein said at least one emulsion layer containing a silver halide emulsion comprises at least one dispersion medium and a plurality of silver halide grains, wherein at least 30% of the total grain projected area of said silver halide grains is accounted for by tabular grains having (i) a {100} face as a major face, (ii) a diameter/thickness aspect ratio of at least 1.5, (iii) a nucleus formed during nucleus formation, said nucleus being present within a square of not more than 10% of the entire projected area of each of said silver halide grains upon viewing said silver halide grains from a direction perpendicular to the major faces, the square containing one corner of each of said silver halide grains, and (iv) a dislocation line, there occurring only one edge intersection of said dislocation line or an extension line of said dislocation line at or within 15% edge length from the nucleus-containing corner upon viewing the silver halide grains from a direction perpendicular to the major faces.

12. The silver halide radiographic material claimed in claim 11, wherein said dissolution resistant electrically conductive material is a metal oxide.

13. A silver halide radiographic material containing an ultraviolet absorbing agent, which comprises a support having provided thereon an emulsion layer containing a silver halide emulsion which comprises at least one dispersion medium and a plurality of silver halide grains, wherein at least 30% of the total grain projected area of said silver halide grains is accounted for by tabular grains having (i) a {100} face as a major face, (ii) a diameter/thickness aspect ratio of at least 1.5, (iii) a nucleus formed during nucleus formation, said nucleus being present within a square of not more than 10% of the entire projected area of each of said silver halide grains upon viewing said silver halide grains from a direction perpendicular to the major faces, the square containing one corner of each of said silver halide grains, and (iv) a dislocation line, there occurring only one edge intersection of said dislocation line or an extension line of said dislocation line at or within 15% edge length from the nucleus-containing corner upon viewing the silver halide grains from a direction perpendicular to the major faces, wherein said silver halide radiographic material is used in combination with a fluorescent intensifying screen which emits a light having a peak at a wavelength of 400 nm or less by X-ray exposure.

14. A silver halide radiographic material used in combination with a fluorescent intensifying screen which emits a light having a peak at a wavelength of 400 nm or less by X-ray exposure, which comprises a support having at least two silver halide emulsion layers provided on at least one side of a support, wherein a first emulsion layer and a second emulsion layer both selected from said at least two silver halide emulsion layers satisfy the following 1) and 2):

1) said first and second emulsion layers both contain a silver halide emulsion which comprises at least one dispersion medium and a plurality of silver halide grains, wherein at least 30% of the total grain projected area of said silver halide grains is accounted for by tabular grains having (i) a {100} face as a major face, (ii) a diameter/thickness aspect ratio of at least 1.5, (iii) a nucleus formed during nucleus formation, said nucleus being present within a square of not more than 10% of the entire projected area of each of said silver halide grains upon viewing said silver halide grains from a direction perpendicular to the major faces, the square containing one corner of each of said silver halide grains, and (iv) a dislocation line, there occurring only one edge intersection of said dislocation line or an extension line of said dislocation line at or within 15% edge length from the nucleus-containing corner upon viewing the silver halide grains from a direction perpendicular to the major faces; and 2) said second emulsion layer is farther from the support than said first emulsion layer, and said second emulsion layer has a higher sensitivity than said first emulsion layer.

* * * * *